US010968869B2

(12) United States Patent
Kato et al.

(10) Patent No.: US 10,968,869 B2
(45) Date of Patent: Apr. 6, 2021

(54) EVAPORATED FUEL PROCESSING DEVICE

(71) Applicant: AISAN KOGYO KABUSHIKI KAISHA, Obu (JP)

(72) Inventors: Nobuhiro Kato, Tokai (JP); Daisaku Asanuma, Gamagori (JP)

(73) Assignee: AISAN KOGYO KABUSHIKI KAISHA, Aichi (JP)

( * ) Notice: Subject to any disclaimer, the term of this patent is extended or adjusted under 35 U.S.C. 154(b) by 154 days.

(21) Appl. No.: 16/098,011

(22) PCT Filed: Feb. 27, 2017

(86) PCT No.: PCT/JP2017/007404
§ 371 (c)(1),
(2) Date: Oct. 31, 2018

(87) PCT Pub. No.: WO2017/195436
PCT Pub. Date: Nov. 16, 2017

(65) Prior Publication Data

US 2019/0145354 A1 May 16, 2019

(30) Foreign Application Priority Data

May 11, 2016 (JP) ..... JP2016-095612

(51) Int. Cl.
*F02M 25/08* (2006.01)
*F02D 41/00* (2006.01)

(52) U.S. Cl.
CPC ..... *F02M 25/0818* (2013.01); *F02D 41/004* (2013.01); *F02M 25/08* (2013.01); *F02M 25/0827* (2013.01); *F02M 25/0836* (2013.01)

(58) Field of Classification Search
CPC ..... F02M 25/08–0836; F02M 25/089; F02D 41/004

(Continued)

(56) References Cited

U.S. PATENT DOCUMENTS 9,759,169 B2 * 9/2017 Makino ..... F02M 25/089
10,294,895 B2 5/2019 Shirai (Continued)

FOREIGN PATENT DOCUMENTS

CN 103797240 A 5/2014
CN 105298690 A 2/2016

(Continued)

OTHER PUBLICATIONS

Chinese Office Action ("CN OA") for CN Pat. App. No. 201780029078.8 dated Apr. 1, 2020 (13 pages total including translation).

(Continued)

*Primary Examiner* — Erick R Solis
*Assistant Examiner* — Robert A Werner
(74) *Attorney, Agent, or Firm* — Shumaker, Loop & Kendrick, LLP

(57) ABSTRACT

A device may determine whether there is a communicated point with open air between a pump and a control valve or on an opposite side to the control valve of the pump, by at least two of pressures: between the pump and the control valve in case the control valve is in a cutoff state, the switching valve is in a communication state, and the pump sends in forward direction, on an opposite side to the control valve of to the pump in case the control valve is in a communication state, the switching valve is in the cutoff state, and the pump sends in reverse direction; and between the pump and the control valve or on the opposite side to the control valve of the pump in case the valves are in the cutoff states and the pump is stopped after one of these cases.

4 Claims, 17 Drawing Sheets

(58) Field of Classification Search
USPC ..... 123/518–521; 73/114.39
See application file for complete search history.

(56) References Cited

U.S. PATENT DOCUMENTS

| | | | | |
|---|---|---|---|---|
| 2002/0011094 | A1 | 1/2002 | Cook | |
| 2002/0035990 | A1 | 3/2002 | Yoshida et al. | |
| 2002/0162457 | A1* | 11/2002 | Hyodo | B01D 53/0454 96/109 |
| 2009/0043476 | A1* | 2/2009 | Saito | B60W 10/30 701/102 |
| 2014/0095049 | A1 | 4/2014 | Jentz et al. | |
| 2014/0299111 | A1 | 10/2014 | Denz | |
| 2016/0017849 | A1* | 1/2016 | Shirai | F02M 35/10222 123/520 |
| 2016/0061154 | A1* | 3/2016 | Swartz | F02D 41/22 123/520 |
| 2017/0152813 | A1* | 6/2017 | Casetti | F02M 25/0809 |
| 2017/0152814 | A1* | 6/2017 | Casetti | F02M 25/0836 |
| 2017/0167415 | A1* | 6/2017 | Tochihara | F02M 35/10222 |
| 2019/0285011 | A1* | 9/2019 | Asanuma | F02M 25/08 |
| 2019/0293031 | A1* | 9/2019 | Dudar | F02D 41/0037 |
| 2019/0331036 | A1* | 10/2019 | Asanuma | F02D 41/0045 |

FOREIGN PATENT DOCUMENTS

| | | | |
|---|---|---|---|
| DE | 19829423 | A1 | 1/2000 |
| DE | 102013109459 | A1 | 4/2014 |
| JP | 2002-138910 | A | 5/2002 |
| JP | 2002-349364 | A | 12/2002 |
| JP | 2003-042014 | A | 2/2003 |
| JP | 2004-353601 | A | 12/2004 |
| JP | 2005-030334 | A | 2/2005 |
| JP | 2007-205210 | A | 8/2007 |
| JP | 2015-96711 | A | 5/2015 |
| JP | 2016-020675 | A | 2/2016 |

OTHER PUBLICATIONS

JP Office Action ("JP OA") Decision of Refusal for JP Pat. App. No. 2016-095612 dated Jun. 2, 2020 (4 pages total including translation).

JP Decision of Dismissal of Amendment for P Pat. App. No. 2016-095612 dated Jun. 2, 2020 (4 pages total including translation).

Written Opinion of the International Searching Authority of PCT International App. No. PCT/JP2017/007404 dated May 9, 2017 with English Translation (19 pages).

International Search Report dated May 9, 2017 in International Patent Application No. PCT/JP2017/007404 (2 pp.).

* cited by examiner

EVAPORATED FUEL PROCESSING DEVICE

TECHNICAL FIELD

The description herein relates to a technique related to an evaporated fuel processing device mounted on a vehicle. Especially, it discloses an evaporated fuel processing device configured to purge evaporated fuel generated in a fuel tank to an intake passage and process the same.

BACKGROUND ART

Japanese Patent Application Publication No. 2002-138910 describes an evaporated fuel processing device. The evaporated fuel processing device is provided with a canister for adsorbing fuel evaporated in a fuel tank and a pump for sending the fuel adsorbed in the canister to an intake pipe of an engine, on a purge passage for passing the fuel evaporated in the fuel tank to the intake pipe. The canister is communicated with the purge passage as well as with open air.

The evaporated fuel processing device is configured to perform failure diagnosis of the purge passage. Specifically, it cuts off communication between the canister and the open air while the pump is driving. Due to this, the purge passage and the fuel tank come to have a negative pressure on an upstream side relative to the pump. Then, the pump is stopped from being driven, and communication between the purge passage and the intake pipe is cut off. Due to this, the purge passage to the fuel tank which are in communication come to have a uniform negative pressure. In this state, a pressure in the purge passage is measured after a predetermined time has elapsed. In a case where there is a decrease in the negative pressure in the purge passage since the communication between the purge passage and the intake pipe was cut off, it is determined that there is a failed point on the purge passage, that is, a point communicated with the open air (leakage).

SUMMARY

In the above technique, a determination is made on whether a failure (that is, an event in which communication with the open air is present at an unintended position) is occurring somewhere within an entire length of the purge passage. However, the position where the failure is occurring in the purge passage cannot be specified. The description herein provides a technique capable of specifying whether an event in which communication with open air is present is occurring on an upstream side or a downstream side relative to a pump in a purge passage.

The description herein discloses an evaporated fuel processing device. The evaporated fuel processing device may comprise a canister disposed on a purge passage extending from a fuel tank to an intake passage of an engine, the canister comprising a purge port connected to the purge passage and an open air port communicating with open air, and the canister configured to adsorb fuel evaporated in the fuel tank; a control valve disposed on the purge passage on an intake passage side relative to the canister and configured to switch between a communication state and a cutoff state, the communication state being a state where the canister and the intake passage communicate through the purge passage, and the cutoff state being a state where communication between the canister and the intake passage is cut off on the purge passage; a pump disposed on the purge passage between the canister and the control valve, and configured to selectively perform one of an operation of sending purge gas in the purge passage in a forward direction from the canister to the control valve and an operation of sending the purge gas in the purge passage in a reverse direction from the control valve to the canister; a switching valve configured to switch between a communication state being a state where the open air port of the canister communicates with the open air and a cutoff state being a state where communication between the open air port of the canister and the open air is cut off; and a controller. The controller may be configured to determine whether there is a communicated point with the open air between the pump and the control valve or there is a communicated point with the open air on an opposite side to the control valve relative to the pump, by using at least two of: a first pressure between the pump and the control valve in a first case where the control valve is in the cutoff state, the switching valve is in the communication state, and the pump performs the operation of sending the purge gas in the forward direction; a second pressure on the opposite side to the control valve relative to the pump in a second case where the control valve is in the communication state, the switching valve is in the cutoff state, and the pump performs the operation of sending the purge gas in the reverse direction; and a third pressure between the pump and the control valve or on the opposite side to the control valve relative to the pump in a case where the control valve and the switching valve are in the cutoff states and the pump is stopped after the first case or the second case.

According to the above configuration, if there is a communicated point with the open air due to a hole or a crack being formed between the pump and the control valve, the first pressure becomes low as compared to a case where there is no communication with the open air and air tightness is maintained. That is, with a flow in the purge passage in the case where the pump performs the operation of sending the purge gas in the forward direction as a reference, the first pressure becomes low if there is a communicated point on a downstream side relative to the pump. Hereinbelow, "upstream" and "downstream" relative to the pump are defined with the flow in the purge passage in the case where the pump performs the operation of sending the purge gas in the forward direction as the reference. Similarly, if a communicated point with the open air is present on the opposite side to the control valve relative to the pump, that is, on the upstream side relative the pump, the second pressure becomes low as compared to a case where no communication with the open air is present. By using these characteristics, the presence of a communicated point with the open air can be specified on whether it is present between the pump and the control valve or on the opposite side to the control valve relative to the pump.

Further, in the case where the control valve and the switching valve are set to the cutoff states and the pump is stopped after one of the first case and the second case, the third pressure becomes low as compared to a case where no communication with the open air is present, if a communicated point with the open air is present on one of the upstream and downstream sides relative to the pump. Due to this, by using the first and third pressures for example, a communicated point with the open air may be specified to be present on the upstream side relative to the pump if a drop in the third pressure is exhibited despite the first pressure being maintained relatively high, that is, despite the downstream side relative to the pump being maintained airtight. Similarly, by using the second and third pressures, a communicated point with the open air may be specified to be present on the downstream side relative to the pump if a drop in the third pressure is exhibited when it is determined that the upstream side relative to the pump is maintained airtight by using the second pressure.

As aforementioned, by using at least two of the first to third pressures, whether the event of communication with the open air is occurring on the upstream side or the downstream side relative to the pump can be specified.

The evaporated fuel processing device may further comprise at least one pressure sensor disposed at least one of between the pump and the control valve and on the opposite side to the control valve relative to the pump. The controller may be further configured to determine whether the at least one pressure sensor operates normally or not by using a detected value by the at least one pressure sensor in a case where the control valve is in the cutoff state, the switching valve is in the communication state, and the pump is stopped. In the case where the control valve is set in the cutoff state, the switching valve is set in the communication state, and the pump is stopped, pressures on both the upstream and downstream relative to the pump become closer to an atmospheric pressure. Due to this, the at least one pressure sensor detects a pressure approximate to the atmospheric pressure. According to this configuration, it may be specified that the at least one pressure sensor is not operating normally by using the detected value of the at least one pressure sensor in the case where the control valve is in the cutoff state, the switching valve is in the communication state, and the pump is stopped.

The evaporated fuel processing device may further comprise: a branch passage comprising one end connected to the purge passage between the pump and the control valve and another end connected to the purge passage between the pump and the canister; a decreased portion disposed on the branch passage and at which a flow passage area of the branch passage is decreased; and an on-off valve disposed on the branch passage and configured to switch between an open state where the purge gas is capable of passing through the on-off valve and a closed state where the purge gas is not capable of passing through the on-off valve. The controller may be configured to determine whether there is the communicated point with the open air between the pump and the control valve by using the first pressure in a case where the on-off valve is in the closed state under the first case and a fourth pressure in a case where the control valve is in the cutoff state, the switching valve is in the communication state, the on-off valve is in the open state, and the pump performs the operation of sending the purge gas in the forward direction. According to this configuration, the determination may be made on whether or not a communicated point with the open air is present on the downstream side relative to the pump by using the fourth pressure in a case where the purge gas passes through the decreased portion when the pump performs the operation of sending the purge gas in the forward direction.

The evaporated fuel processing device may further comprise: a branch passage comprising one end connected to the purge passage between the pump and the control valve and another end connected to the purge passage between the pump and the canister; a decreased portion disposed on the branch passage and at which a flow passage area of the branch passage is decreased; and an on-off valve disposed on the branch passage and configured to switch between an open state where the purge gas is capable of passing through the on-off valve and a closed state where the purge gas is not capable of passing through the on-off valve. The controller may be configured to determine whether there is the communicated point with the open air on the opposite side to the control valve relative to the pump by using the second pressure in a case where the on-off valve is in the closed state under the second case and a fifth pressure in a case where the control valve is in the communication state, the switching valve is in the cutoff state, the on-off valve is in the closed state, and the pump performs the operation of sending the purge gas in the reverse direction. According to this configuration, the determination may be made on whether or not a communicated point with the open air is present on the upstream side relative to the pump by using the fifth pressure in a case where the purge gas passes through the decreased portion when the pump performs the operation of sending the purge gas in the reverse direction.

The controller may be further configured to: estimate a density of the purge gas by using the first pressure; estimate a sixth pressure on the opposite side to the control valve relative to the pump in the second case by using the estimated density of the purge gas; and determine whether there is the communicated point with the open air on the opposite side to the control valve relative to the pump by using the second pressure and the sixth pressure. For example, a pressure in a case where the purge gas is passing through the communicated point with the open air (such as a hole or a crack) under the second case changes according to the density of the purge gas. According to this configuration, in determining whether or not the communicated point with the open air is present on the upstream side relative to the pump by using the second pressure, the determination may be made by using the sixth pressure estimated with consideration to the density of the purge gas.

DESCRIPTION OF EMBODIMENTS

First Embodiment

Figure 1:
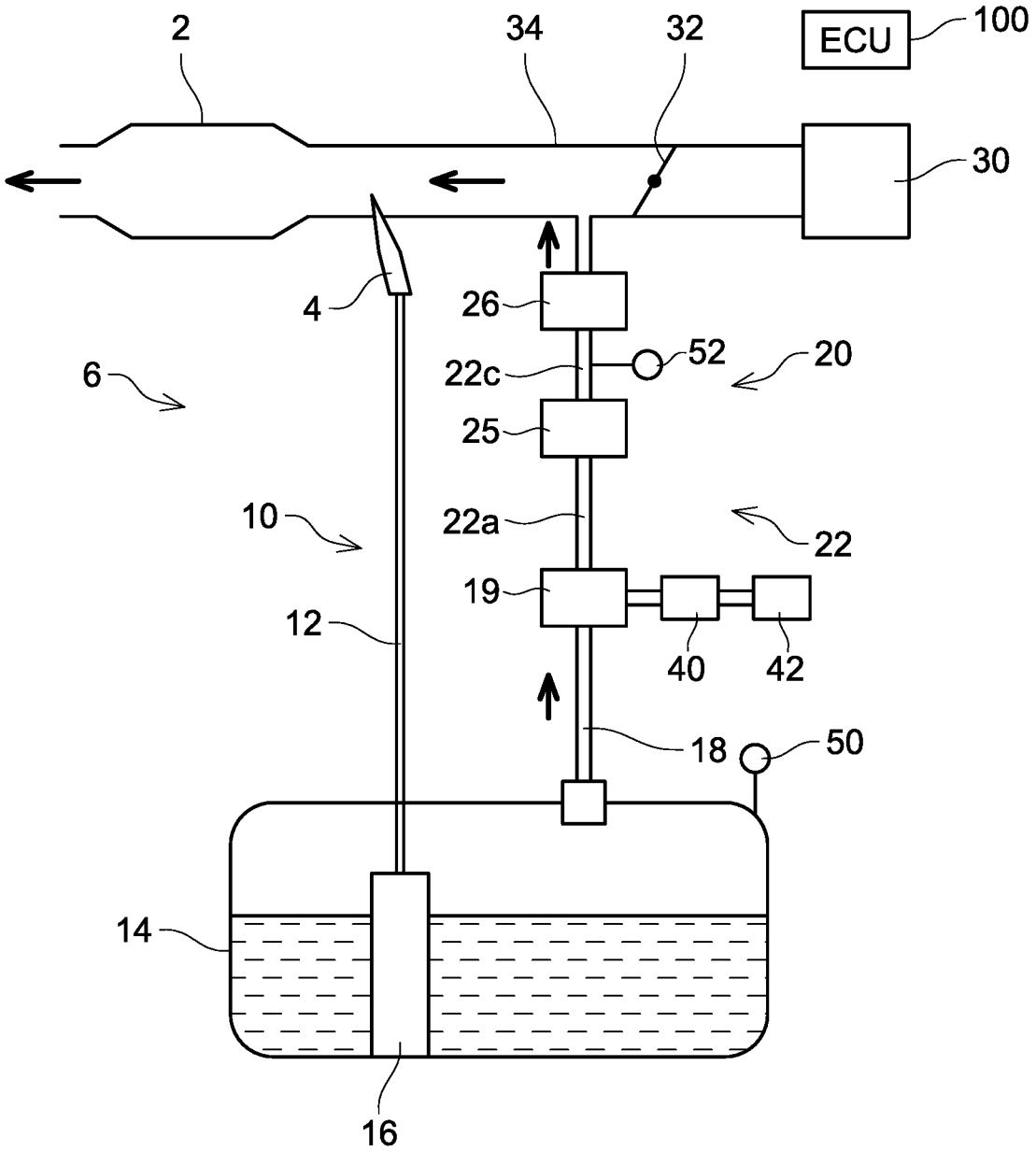
FIG. 1 shows an overview of a fuel supply system of a vehicle of a first embodiment.

A fuel supply system 6 provided with an evaporated fuel processing device 20 will be described with reference to FIG. 1. The fuel supply system 6 is provided with a main supply passage 10 for supplying fuel stored in a fuel tank 14 to an engine 2 and a purge supply passage 22 for supplying evaporated fuel generated in the fuel tank 14 to the engine 2.

The main supply passage 10 is provided with a fuel pump unit 16, a supply passage 12, and an injector 4. The fuel pump unit 16 is provided with a fuel pump, a pressure regulator, a control circuit, and the like. The fuel pump unit 16 controls the fuel pump according to a signal supplied from an ECU 100. The fuel pump boosts pressure of the fuel in the fuel tank 14 and discharges the same. The pressure of the fuel discharged from the fuel pump is regulated by the pressure regulator, and the fuel is supplied from the fuel pump unit 16 to the supply passage 12. The supply passage 12 is connected to the fuel pump unit 16 and the injector 4. The fuel supplied to the supply passage 12 passes through the supply passage 12 and reaches the injector 4. The injector 4 includes a valve (not shown) of which aperture is controlled by the ECU 100. When the valve of the injector 4 is opened, the fuel in the supply passage 12 is supplied to an intake passage 34 connected to the engine 2.

The intake passage 34 is connected to an air cleaner 30. The air cleaner 30 is provided with a filter that removes foreign particles in air that flows into the intake passage 34. A throttle valve 32 is provided in the intake passage 34 between the engine 2 and the air cleaner 30. When the throttle valve 32 opens, air is suctioned from the air cleaner 30 toward the engine 2. The throttle valve 32 adjusts an aperture of the intake passage 34 and adjusts a quantity of air flowing into the engine 2. The throttle valve 32 is provided on an upstream side (air cleaner 30 side) than the injector 4.

The purge supply passage 22 is provided with purge passages 22*a*, 22*c* through which mixed gas of the evaporated fuel from a canister 19 and air (hereinbelow termed "purge gas") passes when it moves from the canister 19 to the intake passage 34. The purge supply passage 22 is provided with the evaporated fuel processing device 20. The evaporated fuel processing device 20 includes the canister 19, the purge passages 22*a*, 22*c*, a pump 25, a control valve 26, pressure sensors 50, 52, a switching valve 40, and an air filter 42. The fuel tank 14 and the canister 19 are connected by a communicating passage 18. The canister 19, the pressure sensor 52, the pump 25, and the control valve 26 are disposed on the purge passages 22*a*, 22*c*. The pressure sensor 50 is disposed on the fuel tank 14. The purge passages 22*a*, 22*c* are connected to the intake passage 34 between the injector 4 and the throttle valve 32. The control valve 26 is a solenoid valve controlled by the ECU 100, and is a valve of which switching between a communication state of being open and a cutoff state of being closed is controlled by duty ratio by the ECU 100. The control valve 26 switches between the communication state where the canister 19 and the intake passage 34 communicate and the cutoff state where communication between the canister 19 and the intake passage 34 is cut off on the purge passage. The control valve 26 adjusts a flow rate of the gas including the evaporated fuel (that is, the purge gas) by controlling its opening and closing time periods (by controlling switching timings between the communication state and the cutoff state). Further, the control valve 26 may be a stepping-motor control valve of which aperture can be adjusted.

Figure 2:
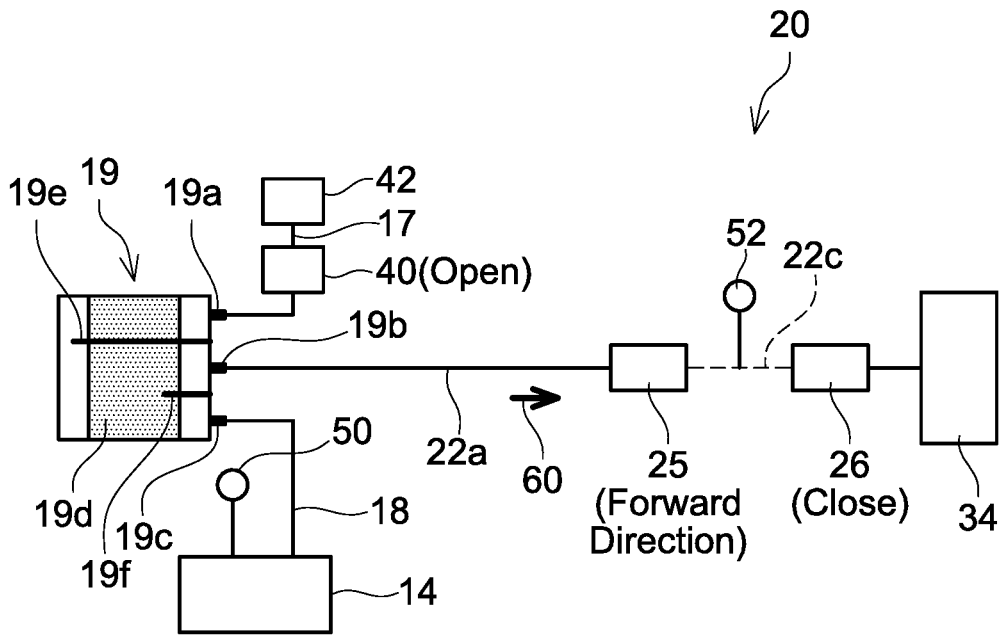
FIG. 2 shows a schematic diagram for explaining a point where a positive pressure is generated on a downstream side relative to a pump by an operation of the pump in a forward direction, in an evaporated fuel processing device of the first embodiment.

The canister 19 will be described with reference to FIG. 2. Broken lines in FIG. 2 show points exhibit a positive pressure in a detecting process to be described later. The same applies to FIGS. 3, 4, and 14 to 16 to be described later. The canister 19 includes an open air port 19*a*, a purge port 19*b*, and a tank port 19*c*. The open air port 19*a* is connected to the air filter 42 via a communicating passage 17. After having passed the air filter 42, air may flow into the canister 19 from the open air port 19*a* through the communicating passage 17 in some cases. At such an occasion, the air filter 42 prevents foreign particles in the air from entering the canister 19. The switching valve 40 is disposed on the communicating passage 17. The switching valve 40 is, for example, a solenoid valve, and is controlled by the ECU 100. The switching valve 40 switches between a communication state of being open to release the communicating passage 17 such that the open air port 19*a* communicates with the open air and a cutoff state of being closed to close the communicating passage 17 such that communication between the open air port 19*a* and the open air is cut off.

The purge port 19*b* is connected to the purge passage 22*a*. The tank port 19*c* is connected to the fuel tank 14 via the communicating passage 18. An activated charcoal 19*d* is accommodated in the canister 19. The ports 19*a*, 19*b*, and 19*c* are provided on one of wall surfaces of the canister 19 facing the activated charcoal 19*d*. A space exists between the activated charcoal 19*d* and the inner wall of the canister 19 on which the ports 19*a*, 19*b*, and 19*c* are provided. A first partitioning plate 19*e* and a second partitioning plate 19*f* are fixed to the inner wall of the canister 19 on a side where the ports 19*a*, 19*b*, and 19*c* are provided. The first partitioning plate 19*e* partitions the space between the activated charcoal 19*d* and the inner wall of the canister 19 in a range between the air port 19*a* and the purge port 19*b*. The first partitioning plate 19*e* extends to a space on an opposite side from the side where the ports 19*a*, 19*b*, and 19*c* are provided. The second partitioning plate 19*f* partitions the space between the activated charcoal 19*d* and the inner wall of the canister 19 in a range between the purge port 19*b* and the tank port 19*c*.

The activated charcoal 19*d* adsorbs the evaporated fuel from the gas that flows into the canister 19 from the fuel tank 14 through the communicating passage 18 and the tank port 19*c*. The gas after the evaporated fuel has been adsorbed is discharged to open air by passing through the air port 19*a*, the communicating passage 17, and the air filter 42. The canister 19 can prevent the evaporated fuel in the fuel tank 14 from being discharged to open air. The evaporated fuel adsorbed by the activated charcoal 19*d* is supplied to the purge passage 22*a* from the purge port 19*b*. The first partitioning plate 19*e* partitions the space where the air port 19*a* is connected and the space where the purge port 19*b* is connected. The first partitioning plate 19*e* prevents the gas containing the evaporated fuel from being discharged to open air. The second partitioning plate 19*f* partitions the space where the purge port 19*b* is connected and the space where the tank port 19*c* is connected. The second partitioning plate 19*f* prevents the gas flowing into the canister 19 from the tank port 19*c* from moving directly to the purge passage 22*a*.

The purge passages 22*a*, 22*c* connects the canister 19 and the intake passage 34. The pump 25 is provided between the purge passage 22*a* and the purge passage 22*c*. The control valve 26 is disposed on an end of the purge passage 22*c* that is on an opposite side to the pump 25. The pump 25 is disposed between the canister 19 and the control valve 26, and pumps the purge gas to the intake passage 34. Specifically, the pump 25 draws the purge gas in the canister 19 through the purge passage 22*a* in a direction of an arrow 60, and pushes the purge gas through the purge passage 22*c* toward the intake passage 34 in a direction of an arrow 66. In a case where the engine 2 is driving, the intake passage 34 is in a negative pressure. Due to this, the evaporated fuel adsorbed in the canister 19 can be introduced to the intake passage 34 by a pressure difference between the intake passage 34 and the canister 19. However, by disposing the pump 25 on the purge passage 22*a*, the evaporated fuel adsorbed in the canister 19 can be supplied to the intake passage 34 even in cases where the pressure in the intake passage 34 is a pressure that is not sufficient for drawing the purge gas therein (such as a positive pressure in a supercharged state generated by a supercharger (not shown), or the negative pressure but with an absolute value being small). Further, by disposing the pump 25, a desired quantity of the evaporated fuel can be supplied to the intake passage 34.

The pump 25 can also operate to suction the purge gas in the purge passage 22*c* and push it out to the purge passage 22*a*. Hereinbelow, the operation by which the pump 25 suctions the purge gas in the purge passage 22*a* and pushes it out to the purge passage 22*c* will be termed an operation of sending the purge gas in a forward direction, and the operation by which the pump 25 suctions the purge gas in the purge passage 22*c* and pushes it out to the purge passage 22*a* will be termed an operation of sending the purge gas in a reverse direction. Further, hereinbelow, "upstream" and "downstream" relative to the pump will be defined with a flow in the purge passages 22*a*, 22*c* in the case where the pump 25 is performing the operation of sending the purge gas in the forward direction as a reference.

The pressure sensor 50 is disposed on the fuel tank 14. The fuel tank 14 is communicated with the purge passage 22*a* on the upstream side relative to the pump 25 via the canister 19. That is, on the upstream side relative to the pump 25, communication is established from the purge passage 22*a* to the fuel tank 14. Due to this, a pressure is uniform from the purge passage 22*a* to the fuel tank 14 on the upstream side relative to the pump 25. The pressure of the purge passage 22*a*, the canister 19, and the fuel tank 14 on the upstream side relative to the pump 25 can be specified by the pressure sensor 50 detecting the pressure in the fuel tank 14. The pressure sensor 52 is disposed on the purge passage 22*c*. That is, the pressure sensor 52 specifies a pressure in the purge passage 22*c* on the downstream side relative to the pump 25. A pressure is uniform in the purge passage 22*c* from the pump 25 to the control valve 26, on the downstream side relative to the pump 25.

In the evaporated fuel processing device 20, when the control valve 26 is opened in a state where the pump 25 is performing the operation of sending the purge gas in the forward direction, the purge gas moves in the direction of the arrow 60 and is introduced to the intake passage 34. Sine the purge passage 22*c* is communicated with the intake passage 34, it exhibits an atmospheric pressure during when the engine 2 is stopped. At this occasion, if the switching valve 40 is open, the upstream side relative to the pump 25 is maintained at the atmospheric pressure. On the other hand, if the switching valve 40 is closed, the upstream side relative to the pump 25 is maintained at a negative pressure.

As shown in FIG. 2, when the control valve 26 is closed in the state where the pump 25 is performing the operation of sending the purge gas in the forward direction, the purge passage 22*c* on the downstream side relative to the pump 25 becomes a closed space, by which it takes a positive pressure. By opening the switching valve 40 at this occasion, the upstream side relative to the pump 25 can be maintained at the atmospheric pressure.

Next, an operation of the evaporated fuel processing device 20 will be described. When a purge condition is satisfied during when the engine 2 is driving, the ECU 100 duty-controls the control valve 26 to perform a purge process. When the purge process is performed, the purge gas is supplied in a direction shown by arrows in FIG. 1. The purge condition is a condition that is satisfied when the purge process of supplying the purge gas to the engine 2 is to be performed, and it is a condition that is preset in the ECU 100 by a manufacturer according to a cooling water temperature of the engine 2 and a concentration of the purge gas. A sensor for specifying the concentration of the purge gas is disposed on the purge passage 22*a* or on the purge passage 22*c*. The ECU 100 constantly monitors whether the purge condition is satisfied or not during when the engine 2 is driving. The ECU 100 controls an output of the pump 25 and a duty ratio of the control valve 26 based on suction air volume and the concentration of the purge gas. When the operation of the pump 25 sending the purge gas in the forward direction is started, the purge gas that had been adsorbed in the canister 19 and the air having passed through the air cleaner 30 are introduced to the engine 2.

The ECU 100 controls an aperture of the throttle valve 32. Further, the ECU 100 also controls a fuel injection amount of the injector 4. Specifically, the ECU 100 controls an opening time period of the valve of the injector 4 to control the fuel injection amount. When the engine 2 is driven, the ECU 100 calculates a fuel injection time period per unit time (that is, the opening time period of the injector 4) during which injection from the injector 4 to the engine 2 is performed. The fuel injection time period is calculated by correcting a reference injection time period specified in advance by experiments by using a feedback correction coefficient to maintain an air-fuel ratio at a target air-fuel ratio (such as an ideal air-fuel ratio). An air-fuel ratio sensor is disposed on a discharge passage of the engine 2.

For example, a hole and a crack may possibly be formed in the purge supply passage 22, such as in the purge passages 22*a*, 22*c*, the canister 19, the fuel tank 14, and the communicating passage 18, due to chronological deteriorations. When a hole is formed, the purge supply passage 22 communicates with open air and the purge gas that is to flow in the purge supply passage 22 might leak to the open air. In the evaporated fuel processing device 20, a detecting process to determine whether or not a hole that might cause a leakage has been formed on the purge supply passage 22 is performed.

Figure 5:
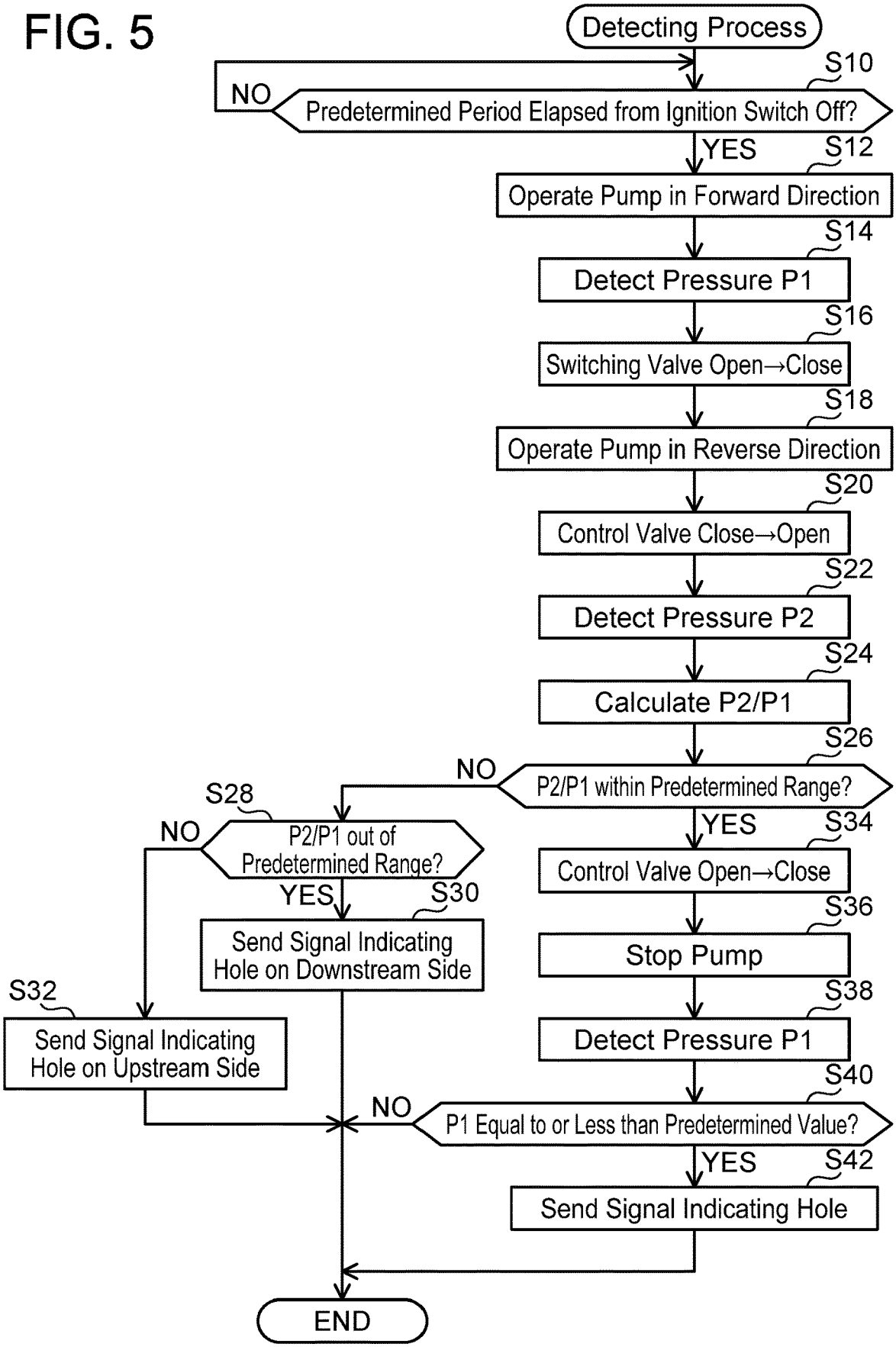
FIG. 5 shows a flowchart of a detecting process of the first embodiment.

The detecting process performed by the ECU 100 will be described with reference to FIG. 5. The detecting process is initiated when an ignition switch of the vehicle is switched from on to off. In a state where the ignition switch is off, normally, the switching valve 40 is open, the control valve 26 is closed, and the pump 25 is stopped. When the detecting process is initiated, in S10, the ECU 100 monitors whether a predetermined period (such as 5 hours) has elapsed since the ignition switch was turned off. The predetermined period is a period equal to or longer than a period over which the purge supply passage 22, which had been at a high temperature during when the vehicle was driving, is cooled by the ignition switch being turned off and the temperature thereof stabilizes. When the predetermined period has elapsed (YES in S10), the ECU 100 causes the pump 25 to perform the operation of sending the purge gas in the forward direction in S12. At this occasion, the switching valve 40 is open and the control valve 26 is closed.

Figure 6:
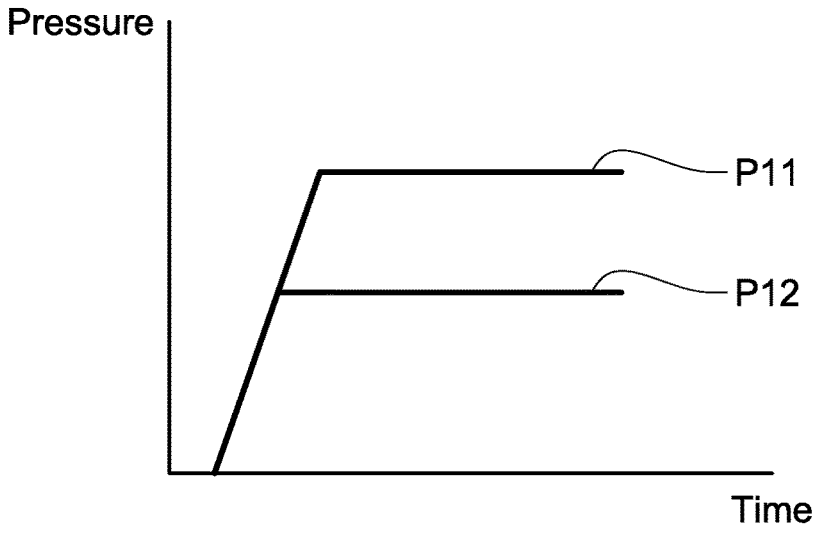
FIG. 6 shows a graph showing a pressure on the downstream side relative to the pump in a state shown in FIG. 2 of the first embodiment.

As a result, a state shown in FIG. 2 is realized. In a case where the purge passage 22*c* on the downstream side relative to the pump 25 is maintained airtight, a pressure P1 detected by the pressure sensor 52 is maintained at a pressure P11 as shown in FIG. 6. The pressure P1 changes according to the concentration of the evaporated fuel in the purge gas (hereinbelow termed "purge concentration"). When the purge concentration changes, a density of the purge gas changes. As a result, the pressure P changes even in a case where the pump 25 is operating at a same rotary speed. On the other hand, if a hole or a crack has formed in the purge passage 22*c* and thus a point where the purge passage 22*c* communicates with the open air is present, leakage of the gas inside the purge passage 22*c* occurs, and the pressure P1 is maintained at a pressure P12 which is lower than the pressure P11 instead of being raised to the pressure P11. The pressure P12 becomes lower when the hole (or crack) formed in the purge passage 22*c* is larger.

Figure 3:
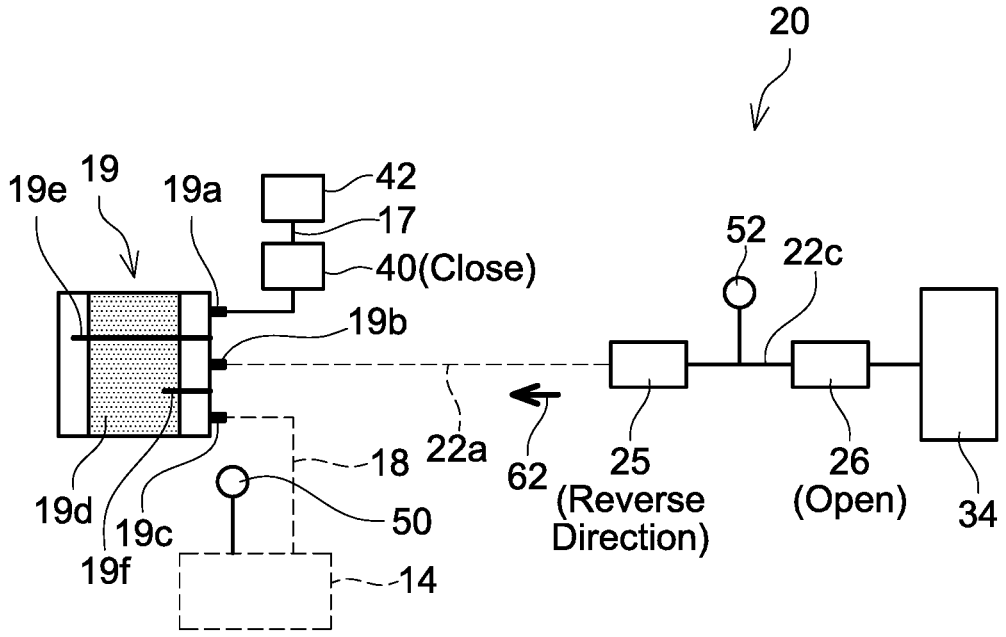
FIG. 3 shows a schematic diagram for explaining a point where a positive pressure is generated on an upstream side relative to the pump by an operation of the pump in a reverse direction, in the evaporated fuel processing device of the first embodiment.
Figure 7:
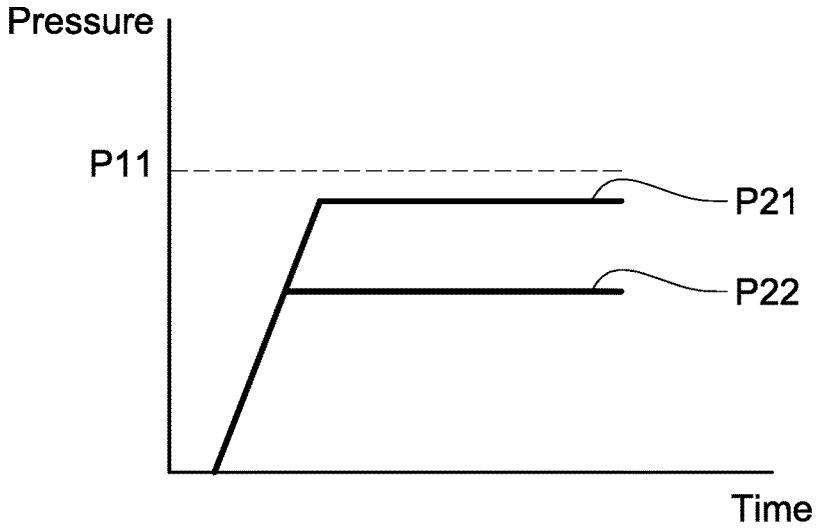
FIG. 7 shows a graph showing a pressure on the upstream side relative to the pump in a state shown in FIG. 3 of the first embodiment.

In S14, the ECU 100 detects the pressure P1 by using the pressure sensor 52. Next, in S16, the ECU 100 switches the switching valve 40 from its open state to closed state. Then, in S18, the ECU 100 causes the pump 25 to perform the operation of sending the purge gas in the reverse direction. Then, in S20, the ECU 100 switches the control valve 26 from its closed state to open state. As a result, a state shown in FIG. 3 is realized. In a case where the purge passage 22*a*, the canister 19, and the fuel tank 14 on the upstream side relative to the pump 25 are maintained airtight, a pressure P2 detected by the pressure sensor 50 is maintained at a pressure P21 as shown in FIG. 7. Similarly to the pressure P1, the pressure P2 changes according to the purge concentration. Further, the pressure P21 is lower than the pressure P11. Since determination on whether a hole, which is the cause of the leakage, is present or not is made by using the pressure, the pressure is preferably detected as high as possible. Due to this, in S12, it is preferable to rotate the pump 25 in the forward direction at a maximum rotary speed which the pump 25 is capable of outputting. The pump 25 is configured mainly to pump the purge gas to the intake passage 34. Due to this, a performance of the pump 25 in performing the operation of sending the purge gas in the reverse direction is inferior to a performance thereof in performing the operation of sending the purge gas in the forward direction, so the rotary speed of the pump 25 in the operation of sending the purge gas in the reverse direction cannot be increased to match the rotary speed of the pump 25 in the operation of sending the purge gas in the forward direction. As a result, the pressure P21 becomes lower than the pressure P11. In a variant, the rotary speed of the pump 25 in the operation of sending the purge gas in the forward direction may be lowered to match the rotary speed of the pump 25 in the operation of sending the purge gas in the reverse direction.

In a case where a communicated point with the open air, such as a hole or a crack, is present on the upstream side relative to the pump 25 and leakage is occurring therefrom, the pressure P2 is maintained at a pressure P22 which is lower than the pressure P21 instead of being raised to the pressure P21. The pressure P22 becomes lower when the hole (or crack) formed in the purge passage 22*a* or the like is larger.

In S22, the ECU 100 detects the pressure P2 by using the pressure sensor 50. Next, in S24, the ECU 100 calculates the pressure P2/the pressure P1. In a case of the pressure P1=P11 and the pressure P2=P21, P2/P1 approximates a value k (such as k=0.8) resulting from the difference in the performances of the pump 25. In S26, the ECU 100 determines whether or not P2/P1 is within a predetermined range. The predetermined range is a range including the aforementioned value k, and it is, for example, $k\times(1-\alpha)\leq P2/P1\leq k\times(1+\alpha)$ (e.g., $\alpha=0.1$).

In a case where P2/P1 is out of the predetermined range (NO in S26), the ECU 100 then determines whether or not P2/P1 is larger than the predetermined range in S28. A case where P2/P1 is larger than the predetermined range (YES in S28) is a case where the pressure P1 is small as compared to the pressure P2, that is, a case where the pressure P12 is detected due to the occurrence of the leakage on the downstream side relative to the pump 25 while the pressure P21 is detected due to no leakage occurring on the upstream side relative to the pump 25. In the case where P2/P1 is larger than the predetermined range (YES in S28), the ECU 100 sends a signal indicating a presence of a hole on the downstream side relative to the pump 25 to a display device of the vehicle in S30 and terminates the detecting process. When receiving the signal sent in S30, the display device of the vehicle displays a display indicating a possibility that the leakage may occur on the downstream side relative to the pump 25. Due to this, a driver can acknowledge the possibility that the leakage may occur on the downstream side relative to the pump 25.

On the other hand, a case where P2/P1 is not larger than the predetermined range, that is, a case where P2/P1 is smaller than the predetermined range (NO in S28), is a case where the pressure P2 is small as compared to the pressure P1, that is, a case where the pressure P11 is detected due to no leakage occurring on the downstream side relative to the pump 25 while the pressure P22 is detected due to the occurrence of the leakage on the downstream side relative to the pump 25. In the case where P2/P1 is smaller than the predetermined range (NO in S28), the ECU 100 sends a signal indicating a presence of a hole on the upstream side relative to the pump 25 to the display device of the vehicle in S32 and terminates the detecting process. When receiving the signal sent in S32, the display device of the vehicle displays a display indicating a possibility that the leakage may occur on the upstream side relative to the pump 25. Due to this, the driver can acknowledge the possibility that the leakage may occur on the upstream side relative to the pump 25.

On the other hand, in a case where P2/P1 is within the predetermined range in S26 (YES in S26), either a case of the pressure P1=P11 and the pressure P2=P21 or a case of the pressure P1=P12 and the pressure P2=P22 can be assumed. The case of the pressure P1=P12 and the pressure P2=P22 is a case where the leakages are present on both the upstream and downstream sides relative to the pump 25. On the other hand, the case of the pressure P1=P11 and the pressure P2=P21 is a case where no leakage is present on both the upstream and downstream sides relative to the pump 25, or a case where a drop in the pressure cannot be detected by the detection method with the operation of the pump 25, despite the presence of the leakage, due to the hole or the crack, which is the cause of the leakage, being too small.

In the case where P2/P1 is within the predetermined range (YES in S26), the processes from S34 detect the case where the leakages are present on both the upstream and downstream sides relative to the pump 25 and the leakage that could not be detected by the processes preceding S32.

Figure 4:
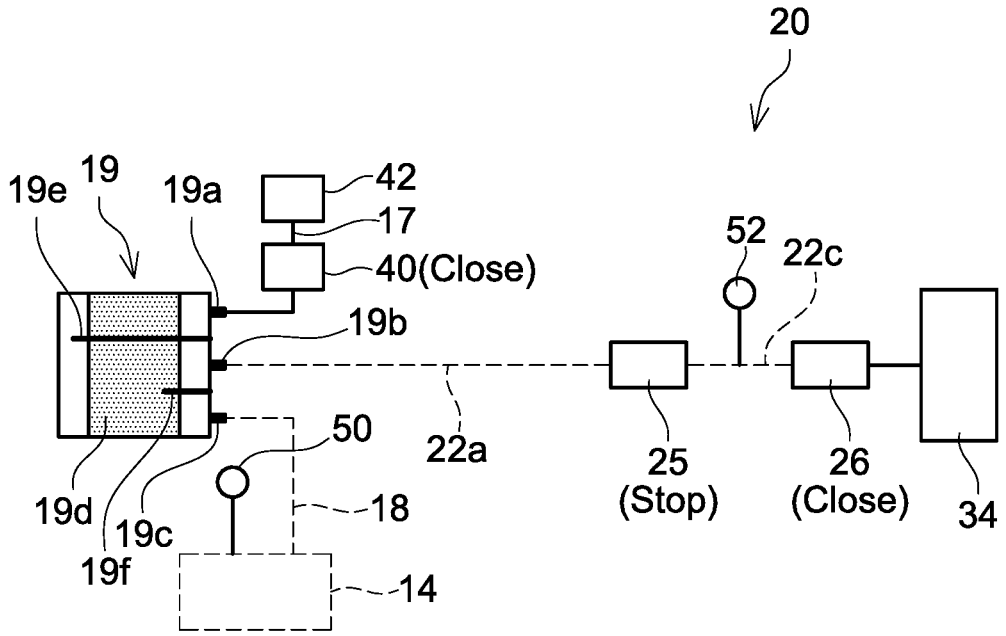
FIG. 4 shows a schematic diagram for explaining points where a positive pressure is generated on the upstream side and the downstream side relative to the pump, in the evaporated fuel processing device of the first embodiment.
Figure 8:
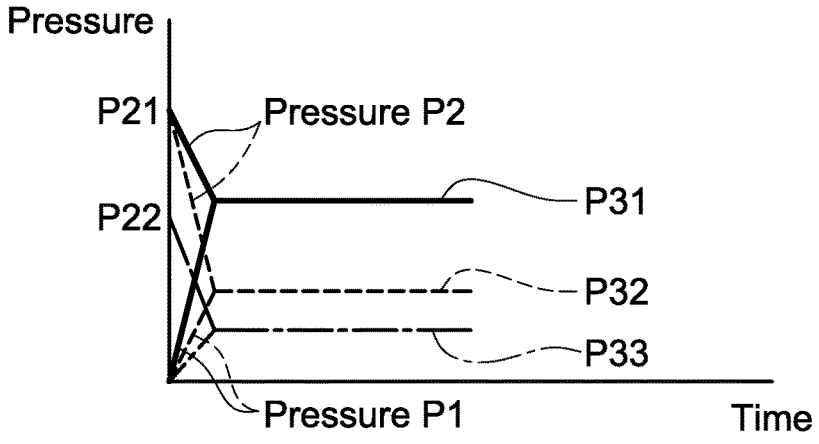
FIG. 8 shows a graph showing pressures on the upstream side and the downstream side relative to the pump in a state shown in FIG. 4 of the first embodiment.

In S34, the ECU 100 switches the control valve 26 from its open state to closed state. As a result, the upstream side relative to the pump 25 is cut off by the switching valve 40, and the downstream side relative to the pump 25 is cut off by the control valve 26. Next, the ECU 100 stops the operation of the pump 25. Due to this, a state shown in FIG. 4 is realized. In this configuration, the upstream and downstream sides relative to the pump 25 communicate through inside of the pump 25. If there is no leakage on both the upstream and downstream sides relative to the pump 25, the upstream side relative to the pump 25 has the pressure P21 and the pressure P1 on the downstream side relative to the pump 25 is the atmospheric pressure in S26. In the state of FIG. 4, inside of the canister 19 is maintained at a positive pressure, however, depiction thereof will be made with a solid line for the sake of easier view. The same applies to the drawings hereinafter. In this case, as shown by solid lines in FIG. 8, the pressure P2 drops from the pressure P21 and the pressure P1 rises from the atmospheric pressure when the state shifts to the state shown in FIG. 4. As a result, the pressures P1, P2 coincide at a pressure P31.

If a leakage which could not be detected by the processes until S32 is present, the upstream side relative to the pump 25 has the pressure P21 and the pressure P on the downstream side relative to the pump 25 is at the atmospheric pressure in S26. In this case, as shown by broken lines in FIG. 8, the pressure P2 (that is, the upstream-side pressure) drops from the pressure P21 while the pressure P1 rises from the atmospheric pressure when the state shifts to the state shown in FIG. 4. However, in this case, since the leakage is occurring on at least one of the upstream and downstream sides relative to the pump 25, the pressures P1, P2 coincide at a pressure P32 which is lower than the pressure P31. When the state shown in FIG. 4 is maintained, the pressure P32 approximates the atmospheric pressure.

If leakages are present on both the upstream and downstream sides of the pump 25, the upstream side relative to the pump 25 has the pressure P22 and the pressure P1 on the downstream side relative to the pump 25 is at the atmospheric pressure in S26. In this case, as shown by one-dot chain lines in FIG. 8, the pressure P2 (that is, the downstream-side pressure) drops from the pressure P22 while the pressure P1 rises from the atmospheric pressure when the state shifts to the state shown in FIG. 4. However, in this case, since the leakages are occurring on both the upstream and downstream sides relative to the pump 25, the pressures P1, P2 coincide at a pressure P33 which is lower than the pressure P31. When the state shown in FIG. 4 is maintained, the pressure P33 drops to approximate the atmospheric pressure.

In S38, the ECU 100 detects the pressure P1 by using the pressure sensor 52. Next, in S40, the ECU 100 determines whether or not the pressure P1 detected in S38 is less than a predetermined value X. The predetermined value X is specified in advance by experiments, and is stored in the ECU 100.

In a case where the pressure P1 is equal to or less than the predetermined value X (YES in S40), the ECU 100 sends a signal indicating that a hole is present on one of the upstream and downstream sides relative to the pump 25 to the display device of the vehicle in S42 and terminates the process. When receiving the signal sent in S42, the display device of the vehicle displays a display indicating that a leakage may occur. Due to this, the driver can acknowledge the possibility that the leakage may occur. On the other hand, in a case where the pressure P1 is larger than the predetermined value X (NO in S40), the detecting process is terminated.

In the detecting process as above, whether the communicated point with the open air is present on the upstream side relative to the pump 25 or on the downstream side relative thereto can be specified by using the pressures P1 and P2 by performing the processes of S24 to S28. Further, even in a case where the communicated point with the open air cannot be detected by the processes of S24 to S28, the communicated point with the open air can be detected by performing the processes from S34.

In S24 to S28, P2/P1 is calculated by using the pressures P1, P2 to determine the presence or absence of the communicated point with the open air. The pressures P1, P2 vary according to the density of the purge gas, aside from the presence and absence of the communicated point with the open air. The density of the purge gas changes according to the purge concentration. Thus, if whether the communicated point with the open air is present or absent is determined by using the pressures P1, P2 independently, it is preferable to take the purge concentration into consideration. By determining the presence or absence of the communicated point with the open air by using P2/P1, an influence of the purge concentration on P2/P1 can be suppressed as compared to the case of making the determination by using the pressures P1, P2 independently. Due to this, the presence or absence of the communicated point with the open air can more accurately be determined by using P2/P1.

In a variant, the presence or absence of the communicated point with the open air may be determined by using the pressures P1, P2 themselves. Specifically, when the pressure P1 is calculated in S14, the pressure P1 may be compared with a threshold Y, and the signal indicating the possibility of the presence of the communicated point with the open air on the downstream side relative to the pump 25 may be sent, similarly to S30, in a case where the pressure P1 is less than the threshold Y. Similarly, when the pressure P2 is calculated in S22, the pressure P2 may be compared with a threshold Z, and the signal indicating the possibility of the presence of the communicated point with the open air on the upstream side relative to the pump 25 may be sent, similarly to S32, in a case where the pressure P2 is less than the threshold Z. In these cases, the ECU 100 may change the thresholds Y, Z according to the purge concentration. For example, the ECU 100 may store tables respectively showing relationships between the thresholds Y, Z and the purge concentration as specified by experiments in advance. Further, the ECU 100 may specify each of the thresholds Y, Z from the tables by using the purge concentration specified by the air-fuel ratio.

As apparent from the above, the pressures P11, P12 are examples of "first pressure", the pressures P21, P22 are examples of "second pressure", and the pressures P31, P32, P33 are examples of "third pressure".

Second Embodiment

Figure 9:
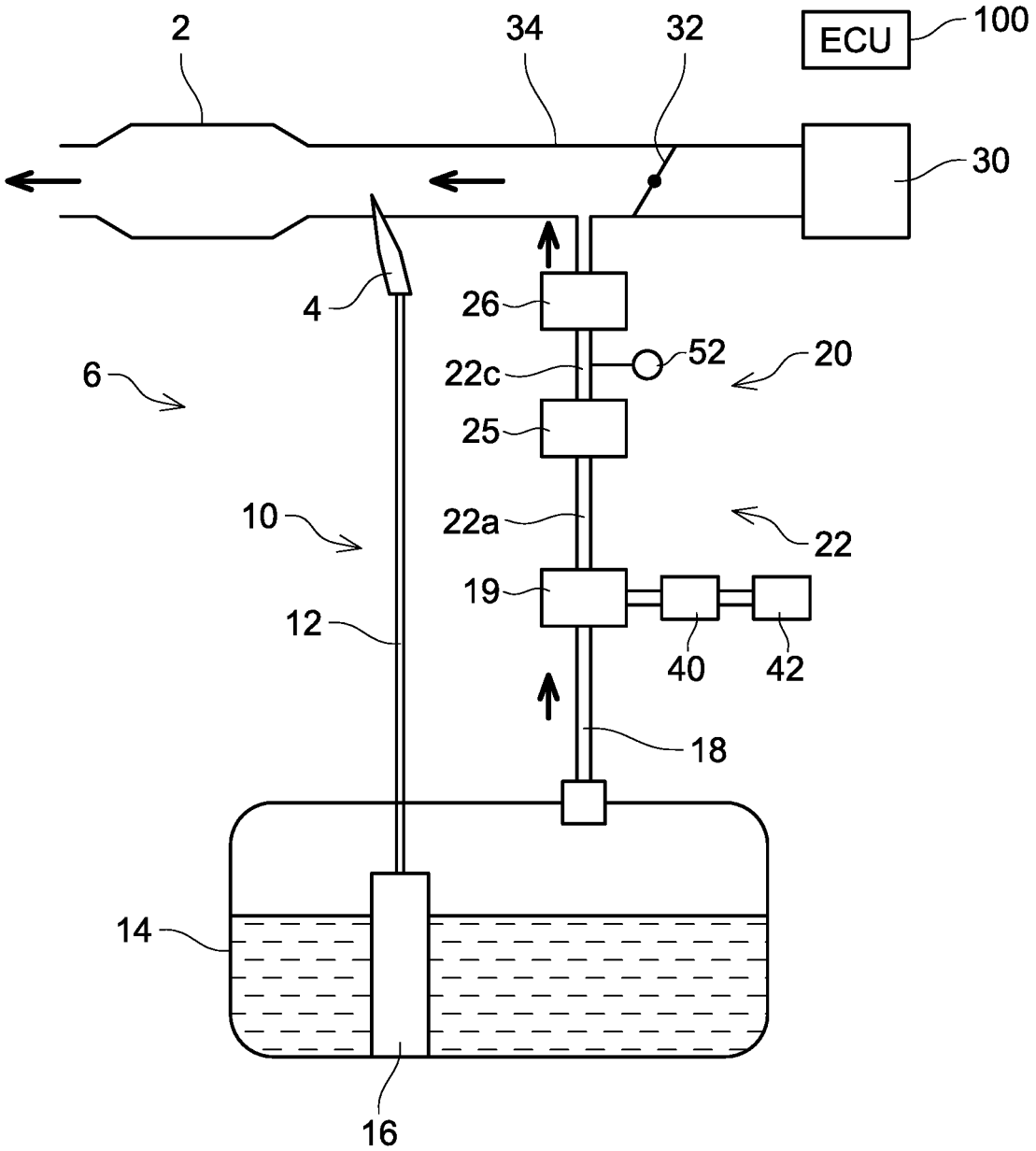
FIG. 9 shows an overview of a fuel supply system of a vehicle of a second embodiment.

Features differing from the first embodiment will be described with reference to FIG. 9. The evaporated fuel processing device 20 of the second embodiment is not provided with the pressure sensor 50. In the detecting process, the ECU 100 performs the processes of S10 to S16, and S36. The ECU 100 does not perform the processes of S18 to S28, S34, and S42. Next, the ECU 100 determines whether or not the pressure P1 detected in S14 is equal to or less than the aforementioned threshold Y which varies according to the purge concentration, and performs the process of S30 in a case of P1≤Y. On the other hand, in a case of P1>Y, the ECU 100 performs the processes of S38 and S40. At this occasion, the process of S32 is performed in the case of YES in S40. In a case where the pressure P1 detected in S38 is equal to or less than the predetermined value despite no hole being present on the downstream side relative to the pump 25, it can be specified that a hole is present on the upstream side relative to the pump 25.

Third Embodiment

Figure 10:
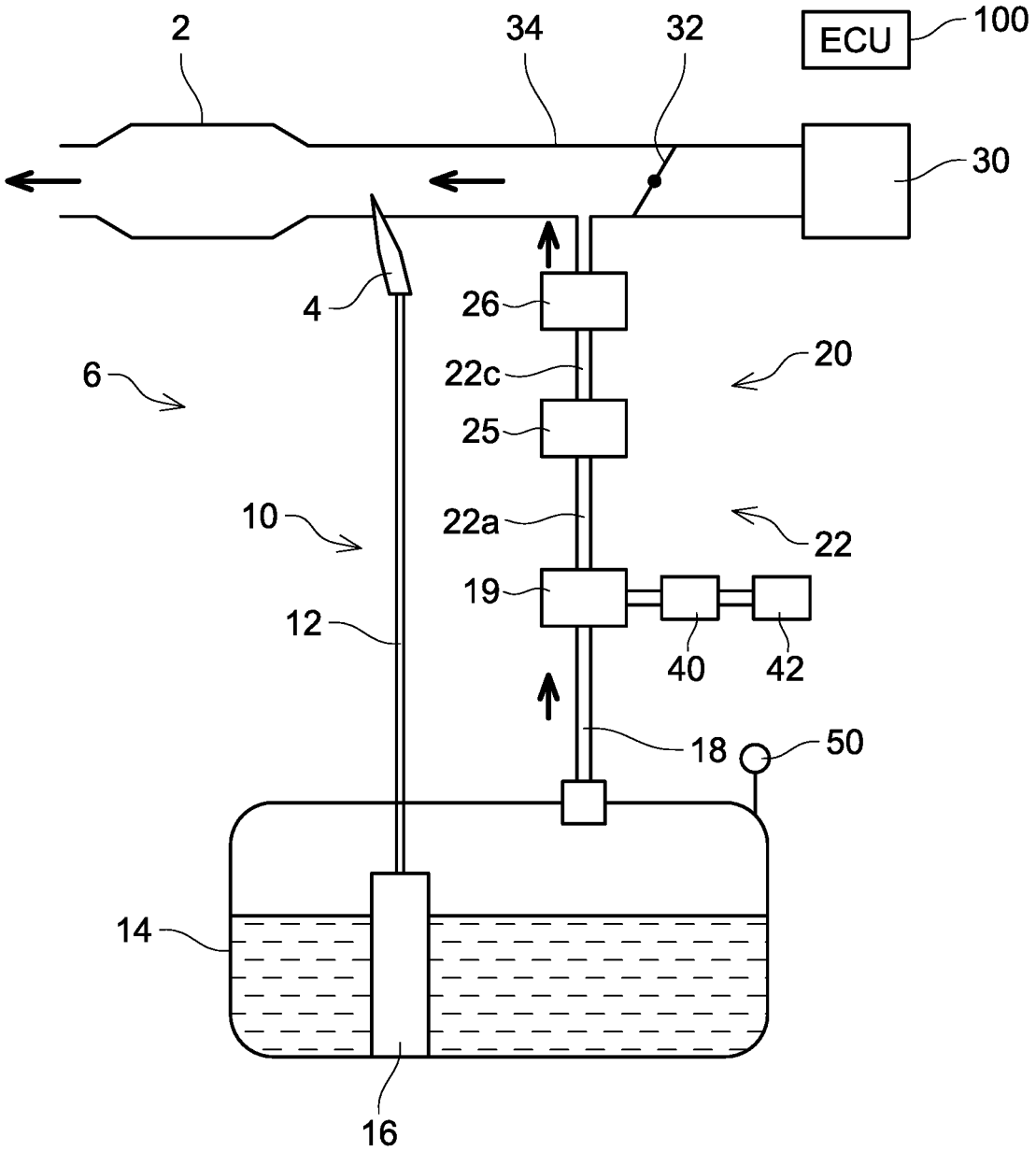
FIG. 10 shows an overview of a fuel supply system of a vehicle of a third embodiment.

Features differing from the first embodiment will be described with reference to FIG. 10. The evaporated fuel processing device 20 of the third embodiment is not provided with the pressure sensor 52. In the detecting process, the ECU 100 performs the processes of S10, 816 to S22, S34, and S36. The ECU 100 may not perform the processes of S12, S14, S24 to S28, and S42. When the process of S36 is completed, the ECU 100 determines whether or not the pressure P2 detected in S22 is equal to or less than the aforementioned threshold Z which varies according to the purge concentration, and may perform the process of S32 in a case of P2≤Z. On the other hand, in a case of P2>Z, the ECU 100 may detect the pressure P2 of the pressure sensor 50 instead of the process of S38. Next, the ECU 100 may determine whether or not the pressure P2 is equal to or less than a predetermined value, instead of the process of S40. Then, the process of S30 may be performed in a case where the pressure P2 is equal to or less than the predetermined value. In a case where the pressure P2 is equal to or less than the predetermined value despite no hole being present on the upstream side relative to the pump 25, it can be specified that a hole is present on the downstream side relative to the pump 25.

Fourth Embodiment

Figure 11:
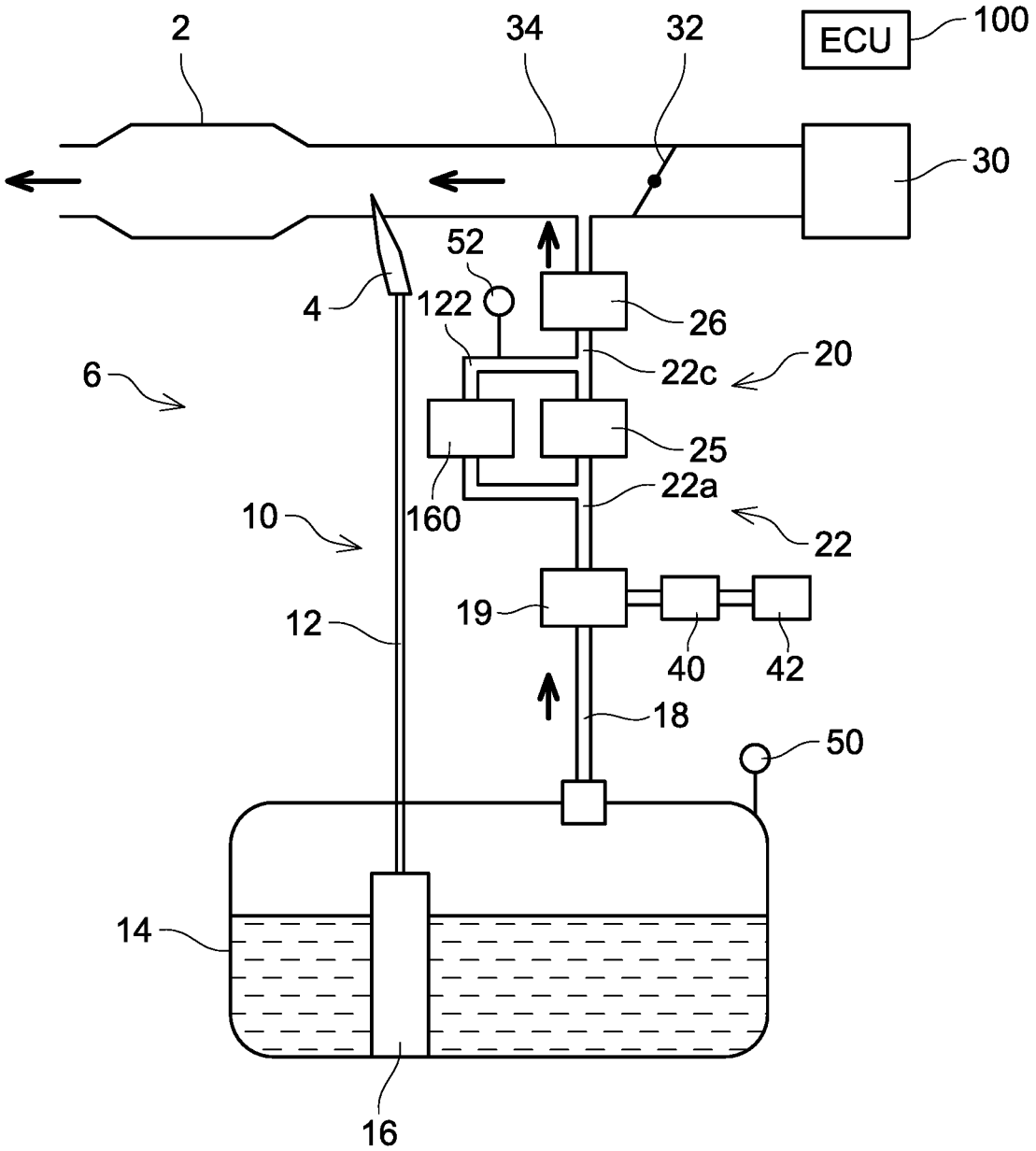
FIG. 11 shows an overview of a fuel supply system of a vehicle of a fourth embodiment.

Features differing from the first embodiment will be described with reference to FIG. 11. The evaporated fuel processing device 20 of the fourth embodiment is provided with a branch passage 122 which branches from the purge passages 22*a*, 22*c* with the pump 25 interposed, on the purge supply passage 22. The branch passage 122 has one end thereof connected to the purge passage 22*a* on the upstream side relative to the pump 25 and has other end thereof connected to the purge passage 22*c* on the downstream side relative to the pump 25. A decreased portion 160 is provided on the branch passage 122. The decreased portion 160 may be a venturi tube, an orifice plate or the like, and it simply needs to have a flow passage area of the branch passage 122 decreased at the decreased portion 160. The pressure sensor 52 is disposed between the decreased portion 160 and the purge passage 22*c*.

In the evaporated fuel processing device 20, when the control valve 26 is opened in a state where the pump 25 is driven, the purge gas moves in the purge supply passage 22 in the forward direction and is introduced to the intake passage 34. On the other hand, when the control valve 26 is closed in the state where the pump 25 is driven, the purge gas flows from an upstream end of the branch passage 122 (that is, the end connected to the purge passage 22*c*) into the branch passage 122, in the purge passage 22*c*. Since the decreased portion 160 is provided on the branch passage 122, the branch passage 122 comes to have a positive pressure. When the switching valve 40 is opened in this state, the upstream side relative to the pump 25 and a downstream side of the branch passage 122 relative to the decreased portion 160 (that is, a section from the end connected to the purge passage 22*a* to the decreased portion 160) are maintained at the atmospheric pressure. Due to this, the purge concentration can be calculated by using a pressure difference between the pressure P1 of the pressure sensor 52 and the pressure P2 of the pressure sensor 50 (the atmospheric pressure).

In the fourth embodiment, the ECU 100 can detect the presence or absence of the communicated point with the open air, that is, the leakage, by performing the detecting process similar to that of any of the first to third embodiments.

Fifth Embodiment

Figure 12:
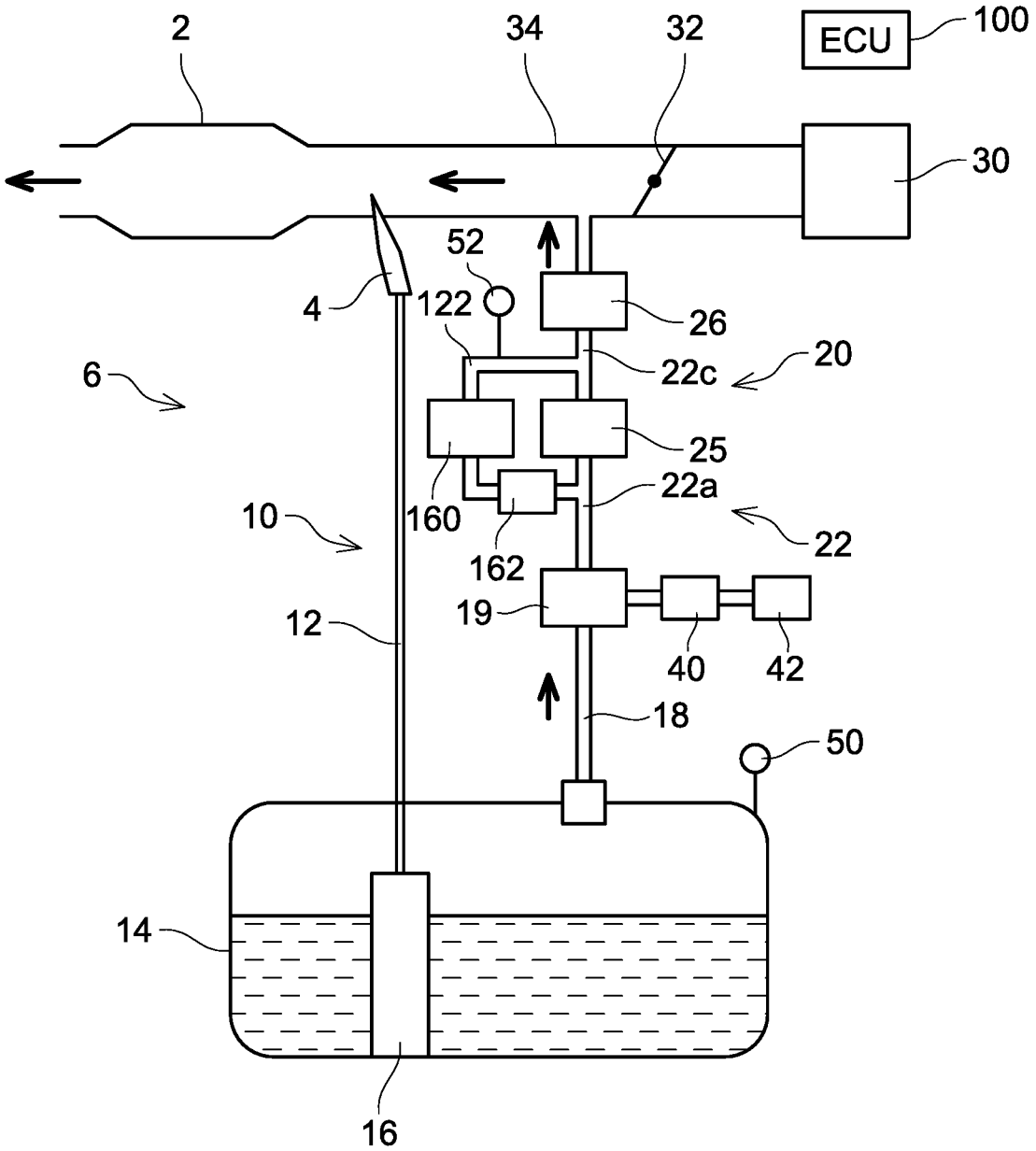
FIG. 12 shows an overview of a fuel supply system of a vehicle of a fifth embodiment.

Features differing from the fourth embodiment will be described. As shown in FIG. 12, the evaporated fuel processing device 20 of the fifth embodiment is provided with an on-off valve 162 disposed on the branch passage 122. The on-off valve 162 is switched between an open state and a closed state by the ECU 100. In a case where the on-off valve 162 is open, communication is established in the branch passage 122 from the one end to the other end thereof. In a case where the on-off valve 162 is closed, the communication in the branch passage 122 is cut off.

The decreased portion 160 includes an opening with a diameter of 0.5 mm (that is, 0.02 inch).

As shown in FIGS. 13 to 16, the evaporated fuel processing device 20 switches among four states by each of the switching valve 40, the on-off valve 162, and the control valve 26 switching between the open state and the closed state and the pump 25 operating in one of the forward and reverse directions. In a state of FIG. 13, the control valve 26 is closed, and the switching valve 40 and the on-off valve 162 are open. Further, the pump 25 is operated in the forward direction. As a result, the purge gas circulates in the branch passage 122 in a direction of an arrow 164. In this state, the purge gas flows to pass through the decreased portion 160.

Figure 14:
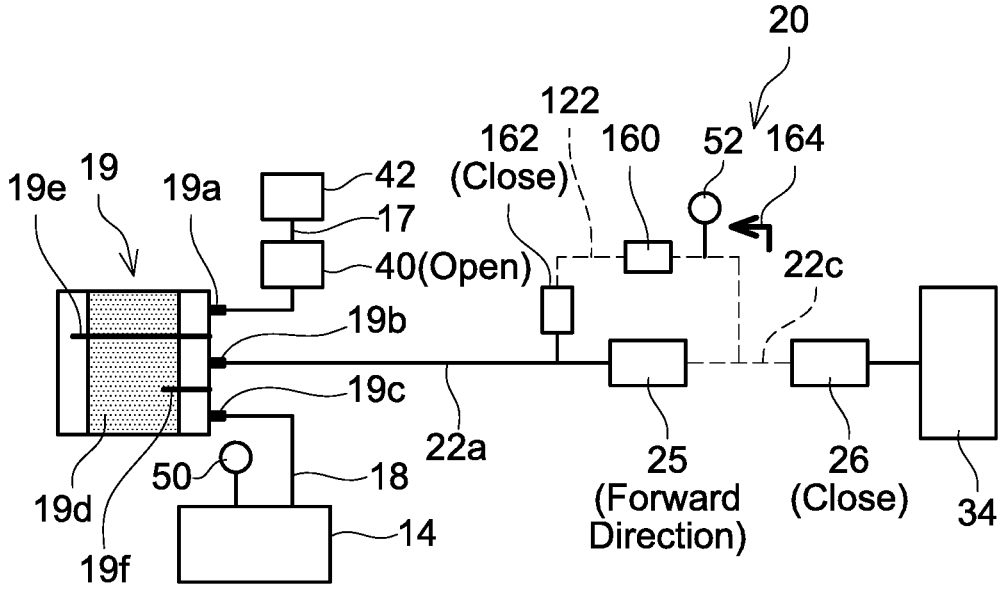
FIG. 14 shows a schematic diagram for explaining a point where a positive pressure is generated on a downstream side relative to the pump by the operation of the pump in the forward direction, in the evaporated fuel processing device of the fifth embodiment.

In a state of FIG. 14, the control valve 26 and the on-off valve 162 are closed and the switching valve 40 is open. Further, the pump 25 is operated in the forward direction. As a result, as shown by a broken line portion in FIG. 14, the downstream side relative to the pump 25 and a purge passage 22*c* side of the branch passage 122 relative to the on-off valve 162 come to have a positive pressure. In a state of FIG. 15, the control valve 26 is open, and the on-off valve 162 and the switching valve 40 are closed. Further, the pump 25 is operated in the reverse direction. As a result, as shown by a broken line portion in FIG. 15, the upstream side relative to the pump 25 (including the canister 19) and a purge passage 22*a* side of the branch passage 122 relative to of the on-off valve 162 come to have a positive pressure. In a state of FIG. 16, the control valve 26 and the switching valve 40 are closed, the on-off valve 162 is open, and the pump 25 is stopped.

The detecting process which the ECU 100 performs will be described with reference to FIGS. 17 and 18. Similarly to the detecting process of the first embodiment, the detecting process is initiated when the ignition switch of the vehicle is switched from on to off. In the state where the ignition switch is off, the switching valve 40 and the on-off valve 162 are open, the control valve 26 is closed, and the pump 25 is stopped. For the detecting process of the present embodiment, processes similar to those of the detecting process of the first embodiment are given the same reference signs as in FIG. 5, and detailed description thereof will be omitted.

Figure 13:
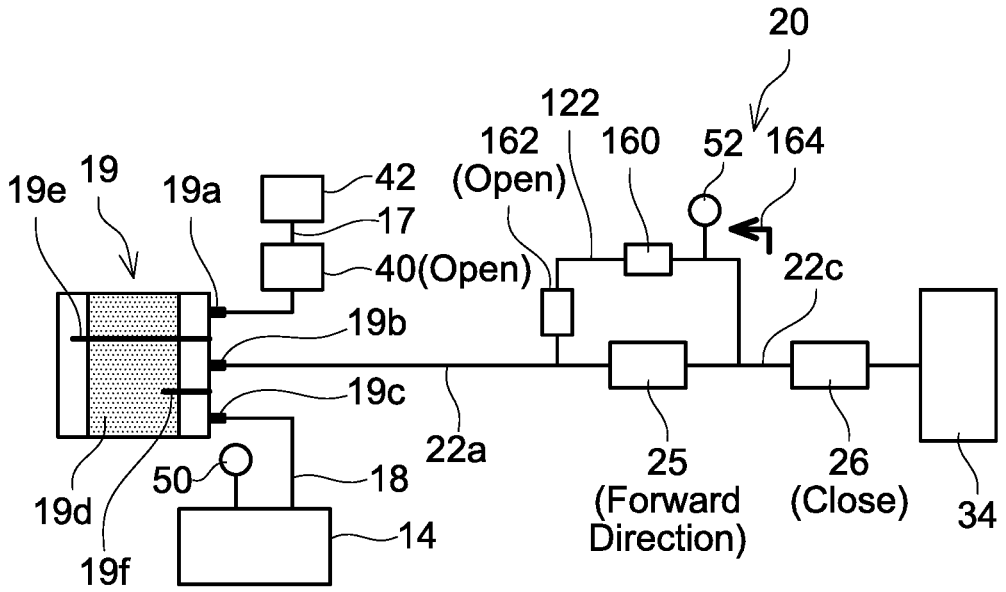
FIG. 13 shows a schematic diagram for explaining a state in which purge gas flows in a branch passage by an operation of a pump in a forward direction, in an evaporated fuel processing device of the fifth embodiment.
Figure 19:
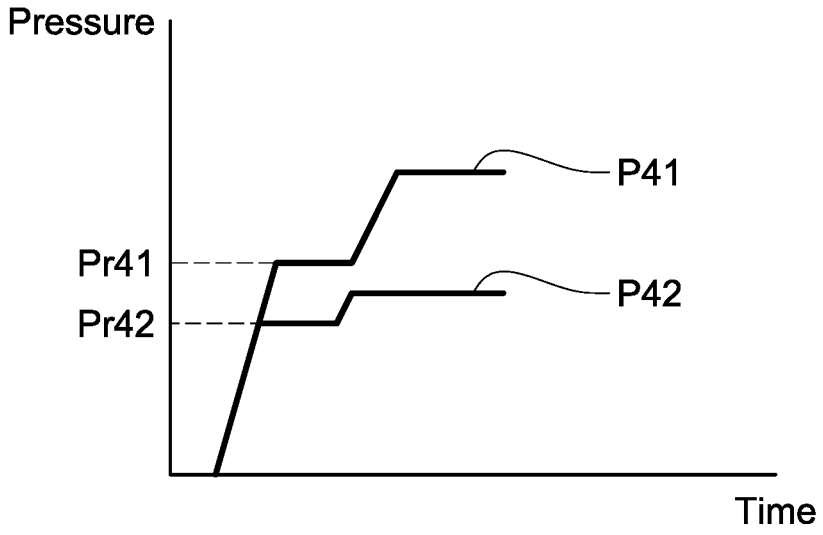
FIG. 19 shows a graph showing a pressure on the downstream side relative to the pump of the fifth embodiment.

When the detecting process is initiated, the processes of S10 and S12 are performed. As a result, the state shown in FIG. 13 is realized. If no leakage is present and airtightness is maintained on the downstream side relative to the pump 25, a pressure Pr1 detected by the pressure sensor 52 is maintained at a pressure Pr41 as shown in FIG. 19. In the state shown in FIG. 13, the switching valve 40 and the on-off valve 162 are open, so the purge passage 22*a* is maintained at the atmospheric pressure. Due to this, the pressure Pr41 is the pressure of the purge gas that passes through the decreased portion 160 and flows to an atmospheric pressure side. In other words, it is the pressure of the purge gas that passes through the opening with the diameter of 0.5 mm and flows to the open air.

On the other hand, in a case where a hole or a crack is present on the downstream side relative to the pump 25, the pressure Pr1 is maintained at a pressure Pr42 which is lower than the pressure Pr41 instead of being raised to the pressure Pr41 as shown in FIG. 19. The pressure Pr42 becomes lower when the hole (or crack) located on the downstream side relative to the pump 25 is larger.

In S114, the ECU 100 detects the pressure Pr1 by using the pressure sensor 52. Next, in S116, the ECU 100 switches the on-off valve 162 from its open state to closed state. As a result, the state shown in FIG. 14 is realized. Next, the ECU 100 performs the process of S14. In the case where no leakage is present and airtightness is maintained on the downstream side relative to the pump 25, the pressure P1 changes to a pressure P41 as shown in FIG. 19. On the other hand, in the case where a leakage is present on the downstream side relative to the pump 25, the pressure P1 changes to Pr42.

Next, in S118, by using the pressure Pr1 detected in S114 and the pressure P1 detected in S14, a determination is made on whether or not P1/Pr1 is within a first range. P1/Pr1 becomes smaller when a hole (or a crack), which is the cause of the leakage, is larger. The first range is a range including a value m that is specified in advance by experiments and is a value of P1/Pr1 in the case where no leakage is present on the downstream side relative to the pump 25. The first range is, for example, $m\times(1-\beta)\leq P1/Pr1\leq m\times(1+\beta)$ (for example, $\beta=0.1$). Use of this predetermined range including the value m is to take individual differences in performances of the pump 25 into account. A case where P1/Pr1 is not included in the first range including the value m (NO in S118) is a case where a leakage is present on the downstream side relative to the pump 25.

In the case of NO in S118, the ECU 100 determines in S120 whether or not P1/Pr1 is within a second range including a value n, that is, $n\times(1-\gamma)\leq P1/Pr1\leq n\times(1+\gamma)$ (for example, $\gamma=0.1$). The value n is a value of P1/Pr1 specified in advance by experiments and is a value of P1/Pr1 in a case where a hole equaling an area of a circle with a diameter of 0.5 mm is formed on the downstream side relative to the pump 25 and a leakage is occurring therefrom. The value n is smaller than the value m, and an upper limit of the second range (that is, $n\times(1+\gamma)$) in S120 is smaller than a lower limit of the first range (that is, $m\times(1-\beta)$) in S118. Use of the second range including the value n is to take the individual differences in performances of the pump 25 into account.

In a case where P1/Pr1 is included in the second range (YES in S120), it can be determined that the leakage is occurring because of the hole equaling the area of the circle with the diameter of 0.5 mm on the downstream side relative to the pump 25. In the case of YES in S120, the ECU 100 sends a signal indicating that the leakage by the hole with the diameter of 0.5 mm is occurring on the downstream side relative to the pump 25 to the display device of the vehicle in S122 and terminates the detecting process. When receiving the signal sent in S122, the display device of the vehicle displays a display indicating that the hole with the diameter of 0.5 mm is formed.

On the other hand, in a case where P1/Pr1 is not included in the second range (NO in S120), a determination is made in S124 whether or not P1/Pr1 is within a third range that is between the upper limit of the second range (that is, $n\times(1+\gamma)$) and the lower limit of the first range (that is, $m\times(1-\beta)$). In a case where P1/Pr1 is a value between the upper limit of the predetermined range of S120 and the lower limit of the predetermined range of S118 (YES in S124), the ECU 100 sends a signal indicating that the leakage by a hole with a diameter smaller than 0.5 mm is occurring on the downstream side relative to the pump 25 to the display device of the vehicle in S128 and terminates the detecting process. When receiving the signal sent in S128, the display device of the vehicle displays a display indicating that the hole with the diameter smaller than 0.5 mm is formed.

On the other hand, in a case where P1/Pr1 is not a value between the upper limit of the predetermined range of S120 and the lower limit of the predetermined range of S118 (NO in S124), that is, in a case where P1/Pr1 is smaller than the lower limit of the predetermined range of S120, the ECU 100 sends a signal indicating that the leakage by a hole with a diameter larger than 0.5 mm is occurring on the downstream side relative to the pump 25 to the display device of the vehicle in S126 and terminates the process. When receiving the signal sent in S126, the display device of the vehicle displays a display indicating that the hole with the diameter larger than 0.5 mm is formed.

According to this configuration, the driver can detect a size of the hole of the communicated point with the open air by checking the display device. Due to this, in a case where standards of repair are set according to the size of the hole, the above can be used as a determination criterion on whether the repair should be done soon or not.

Figure 15:
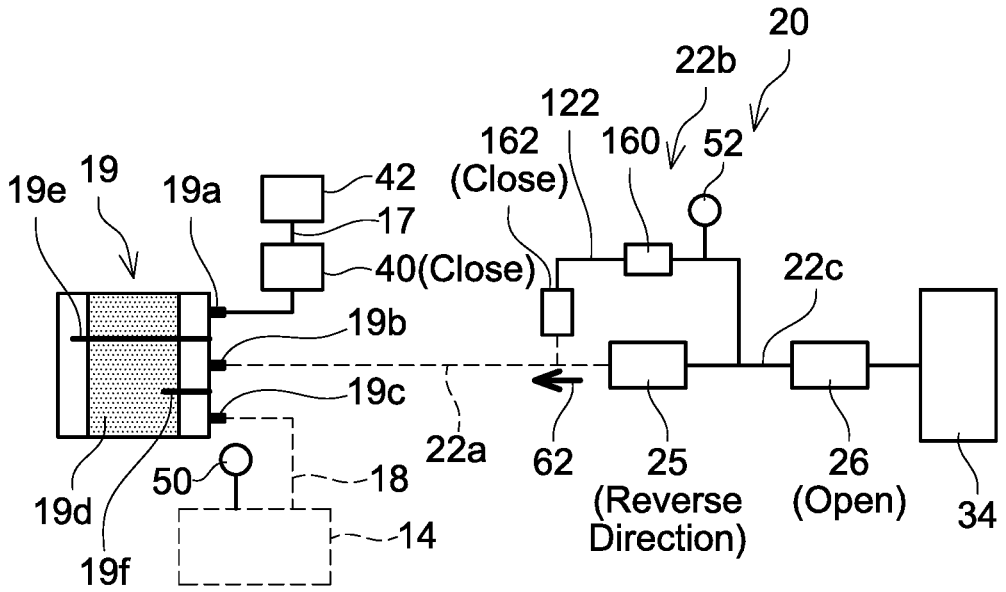
FIG. 15 shows a schematic diagram for explaining a point where a positive pressure is generated on an upstream side relative to the pump by an operation of the pump in a reverse direction, in the evaporated fuel processing device of the fifth embodiment.
Figure 18:
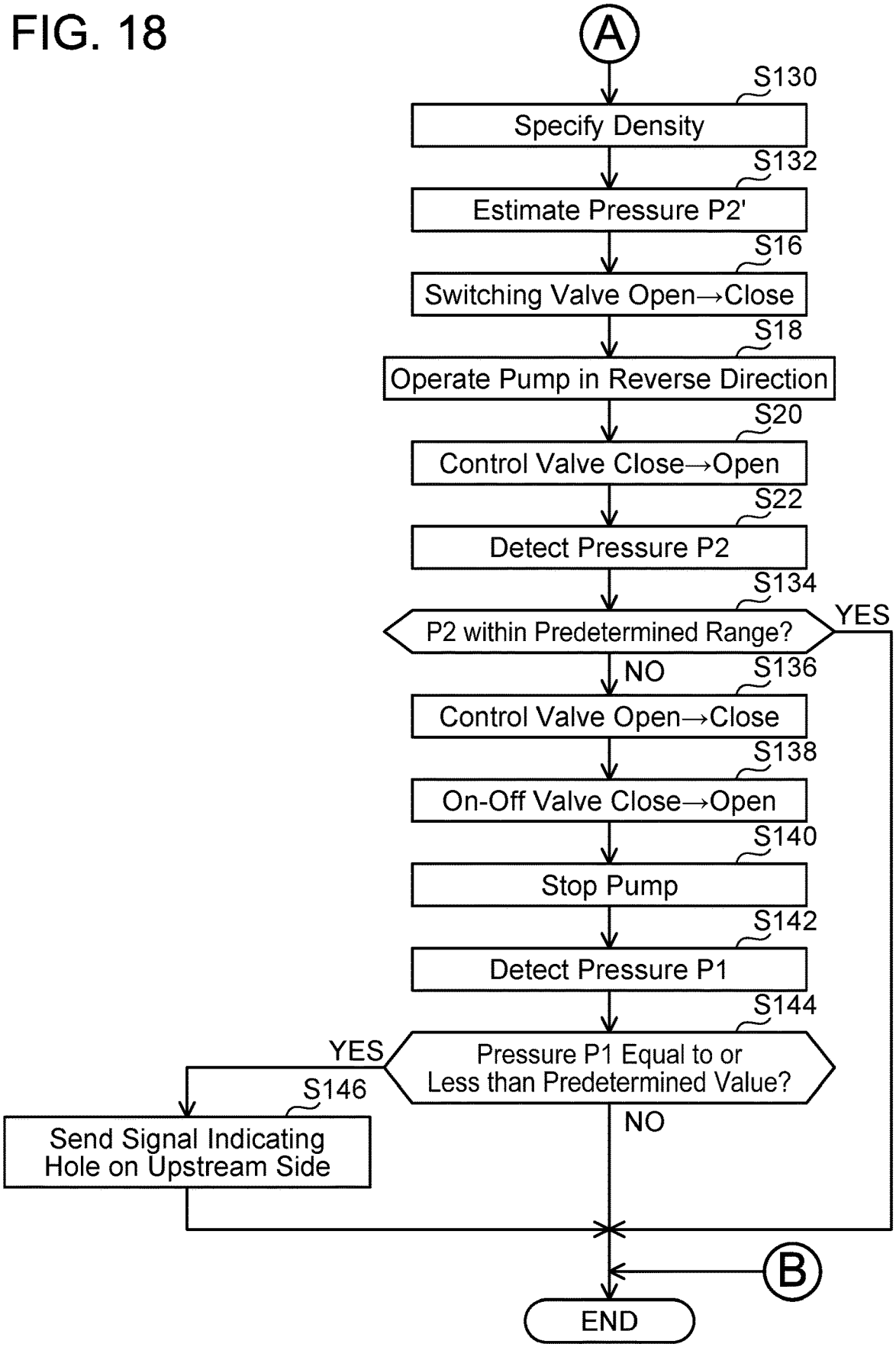
FIG. 18 shows a flowchart of the detecting process of the fifth embodiment continued from FIG. 17.

On the other hand, in a case where P1/Pr1 is within the predetermined range (YES in S118), the ECU 100 uses the pressure Pr1 detected in S114 to specify the density of the purge gas in S130 of FIG. 18. Specifically, the ECU 100 stores a data table indicating a relationship between the pressure Pr1 and the density of the purge gas as specified in advance by experiments. The ECU 100 specifies the density of the purge gas registered in the data table in association with the pressure Pr1 detected in S114. Then, in S132, by using the density specified in S130, a pressure on the upstream side relative to the pump 25 in the case where no leakage is present on the upstream side relative to the pump 25 (that is, the pressure P2 to be detected by the pressure sensor 50) in the state shown in FIG. 15 is estimated (hereinbelow termed "estimated pressure P2'"). Specifically, the ECU 100 stores a data table indicating a relationship between the estimated pressure P2' and the density of the purge gas as specified in advance by experiments. The ECU 100 specifies the estimated pressure P2' registered in the data table in association with the density specified in S130.

Next, the processes of S16 to S22 are performed. Due to this, the pressure P2 is detected by the pressure sensor 50 in the state shown in FIG. 15. Next, in S134, the ECU 100 uses the estimated pressure P2' and the pressure P2 detected in S22 to determine whether or not the pressure P2 is within a predetermined range determined based on the estimated pressure P2'. Specifically, the ECU 100 determines whether or not the pressure P2 is included within ±γ % (for example, γ=5%) of the estimated pressure P2'. In a case where the pressure P2 is included in the predetermined range determined based on the estimated pressure P2' (YES in S134), the detecting process is terminated. In this case, it can be said that no hole is present on the upstream and downstream sides relative to the pump 25.

Figure 16:
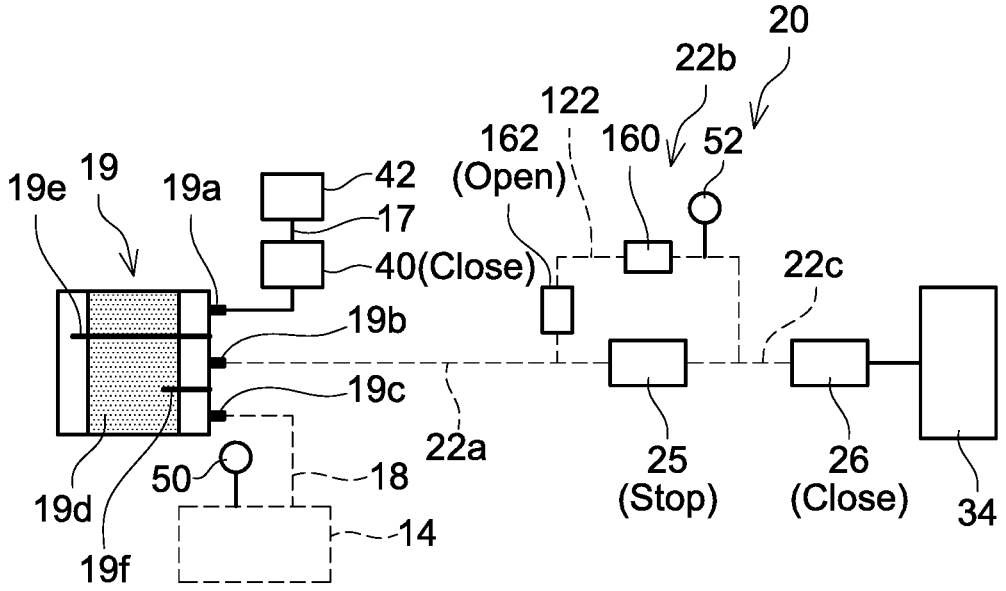
FIG. 16 shows a schematic diagram for explaining points where a positive pressure is generated on an upstream side and a downstream side relative to a pump, in an evaporated fuel processing device of a sixth embodiment.

In a case where the pressure P2 is not included in the predetermined range determined based on the estimated pressure P2' (NO in S134), there is a high possibility that a hole is present on the upstream side relative to the pump 25. On the other hand, even in a case where no hole is present, there is a possibility that the pressure P2 is not included in the predetermined range determined based on the estimated pressure P2' due to the performance of the pump 25. Thus, in the present embodiment, a determination is made on whether or not a hole is present on the upstream side relative to the pump 25, by using a state of FIG. 16. Specifically, in S136, the ECU 100 switches the control valve 26 from its open state to closed state. Then, in S138, the ECU 100 switches the on-off valve 162 from its closed state to open state. Then, in S140, the ECU 100 stops the pump 25. As a result, the state of FIG. 16 is realized. Next, in S142, the ECU 100 detects the pressure P1 by using the pressure sensor 52. Then, in S144, the ECU determines whether the pressure P1 detected in S142 is equal to or less than a predetermined value R. The predetermined value R is specified in advance by experiments, and is stored in the ECU 100.

In a case where the pressure P1 is equal to or less than the predetermined value R (YES in S144), the ECU 100 sends a signal indicating that a hole is present on the upstream side relative to the pump 25 to the display device of the vehicle in S146 and terminates the process. When receiving the signal sent in S146, the display device of the vehicle displays a display indicating a possibility of the presence of a hole. Due to this, the driver can acknowledge the possibility of the presence of the hole. On the other hand, in a case where the pressure P1 is larger than the predetermined value R (NO in S144), the detecting process is terminated.

Sixth Embodiment

Figure 20:
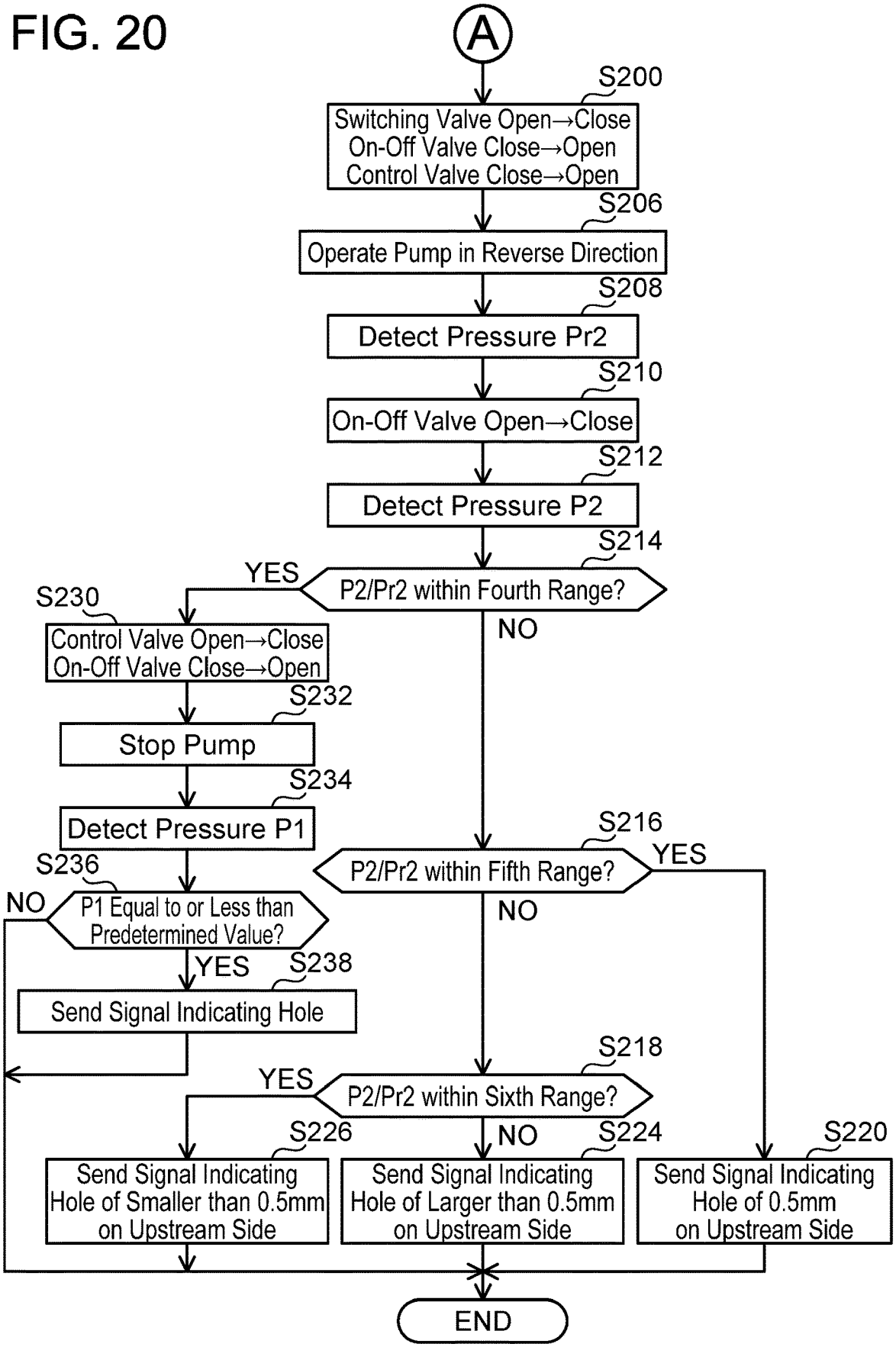
FIG. 20 shows a flowchart of a detecting process of the sixth embodiment.
Figure 21:
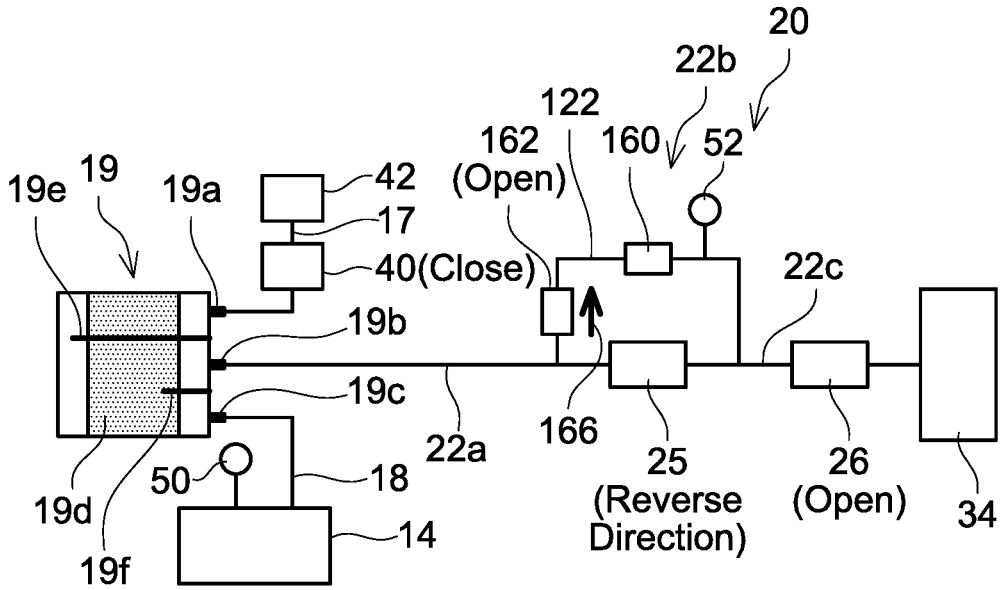
FIG. 21 shows a schematic diagram for explaining a state in which purge gas flows in a branch passage by an operation of a pump in a reverse direction, in the evaporated fuel processing device of the sixth embodiment.

Features differing from the fifth embodiment will be described. In this embodiment, the detecting process is different as compared to the fifth embodiment. In the detecting process of the present embodiment, the processes similar to S10 to S128 of FIG. 17 are performed to detect the presence of a hole on the downstream side relative to the pump 25. Next, in the case of YES in S118, the ECU 100 switches the switching valve 40 from its open state to closed state, the on-off valve 162 from its closed state to open state, and the control valve 26 from its closed state to open state in S200 as shown in FIG. 20. Next, in S206, the ECU 100 causes the pump 25 to perform the operation of sending the purge gas in the reverse direction. Due to this, a state of FIG. 21 is realized. In this state, the purge gas flows from the purge passage 22*a* toward the decreased portion 160 as shown by an arrow 166. In this state, the purge gas flows to pass through the decreased portion 160 in the reverse direction as compared to the state of FIG. 13.

If no leakage is present and airtightness is maintained on the upstream side relative to the pump 25, a pressure Pr2 detected by the pressure sensor 50 is maintained at a relatively high pressure. Since the control valve 26 is open in the state shown in FIG. 21, the purge passage 22*c* is maintained at the atmospheric pressure. Due to this, the pressure Pr2 is the pressure of the purge gas that passes through the decreased portion 160 and flows to the atmospheric pressure side. In other words, the pressure Pr2 is the pressure of the purge gas that passes through the opening with the diameter of 0.5 mm and flows to the open air.

On the other hand, in a case where a hole is present on the upstream side relative to the pump 25, the pressure Pr2 is maintained at a relatively low pressure. In S208, the ECU 100 detects the pressure Pr2 by using the pressure sensor 50. Then, in S210, the ECU 100 switches the on-off valve 162 from its open state to closed state. As a result, the state shown in FIG. 15 is realized. Next, in S212, the ECU 100 detects the pressure P2 by using the pressure sensor 50. If no hole is present and airtightness is maintained on the upstream side relative to the pump 25, the pressure P2 rises to a relatively high pressure. On the other hand, if a hole is present on the upstream side relative to the pump 25, the pressure P2 changes to a relatively low pressure.

Figure 17:
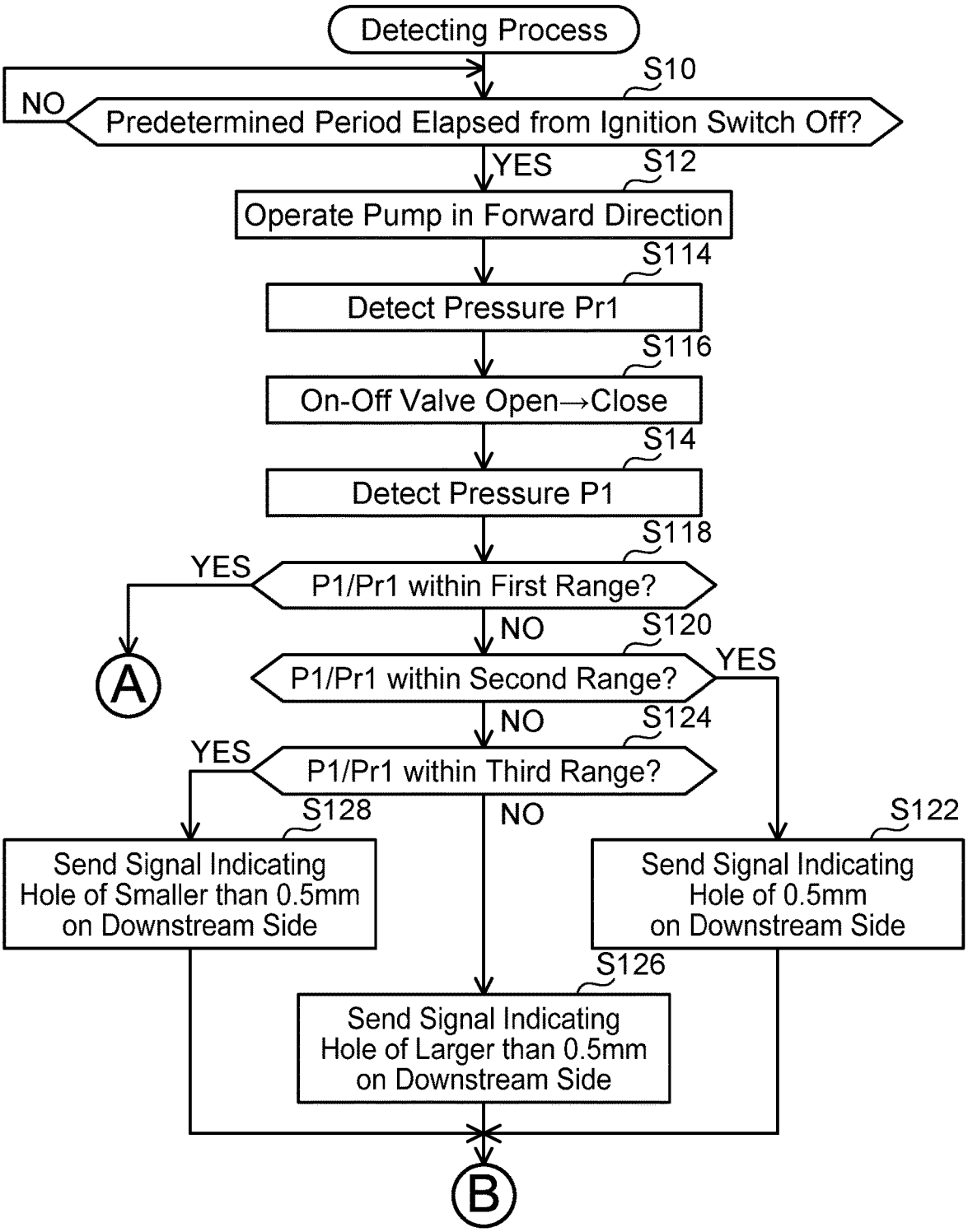
FIG. 17 shows a flowchart of a detecting process of the fifth embodiment.

S214 to S218 are performed similarly to S118, S120, and S124 of FIG. 17. Similarly to the first to third ranges, fourth to sixth ranges are specified by experiments in advance and are stored in the ECU 100. In a case of YES in S216, the ECU 100 sends a signal indicating that a hole with a diameter of 0.5 mm is present on the upstream side relative to the pump 25 to the display device of the vehicle in S220 and terminates the process. In a case of YES in S218, the ECU 100 sends a signal indicating that a hole with a diameter smaller than 0.5 mm is present on the upstream side relative to the pump 25 to the display device of the vehicle in S226 and terminates the process. In a case of NO in S218, the ECU 100 sends a signal indicating that a hole with a diameter larger than 0.5 mm is present on the upstream side relative to the pump 25 to the display device of the vehicle in S224 and terminates the process.

In a case of YES in S214 (that is, P2/Pr2 is within the fourth range), the ECU 100 switches the control valve 26 from its open state to closed state and the on-off valve 162 from its closed state to open state in S230. Next, in S232, the ECU 100 stops the pump 25. As a result, the state of FIG. 16 is realized. Next, in S234, the ECU 100 detects the pressure P1 by using the pressure sensor 52. Then, in S236, the ECU 100 determines whether or not the pressure P1 detected in S234 is equal to or less than a predetermined value S. The predetermined value S is specified in advance by experiments and is stored in the ECU 100.

In a case where the pressure P1 is equal to or less than the predetermined value S (YES in S236), the ECU 100 sends a signal indicating that a hole is present on the upstream side or downstream side relative to the pump 25 to the display device of the vehicle in S238 and terminates the process. When receiving the signal sent in S238, the display device of the vehicle displays a display indicating the possibility of the presence of the hole. On the other hand, in a case where the pressure P1 is greater than the predetermined value S (NO in S238), the detecting process is terminated.

Seventh Embodiment

Figure 22:
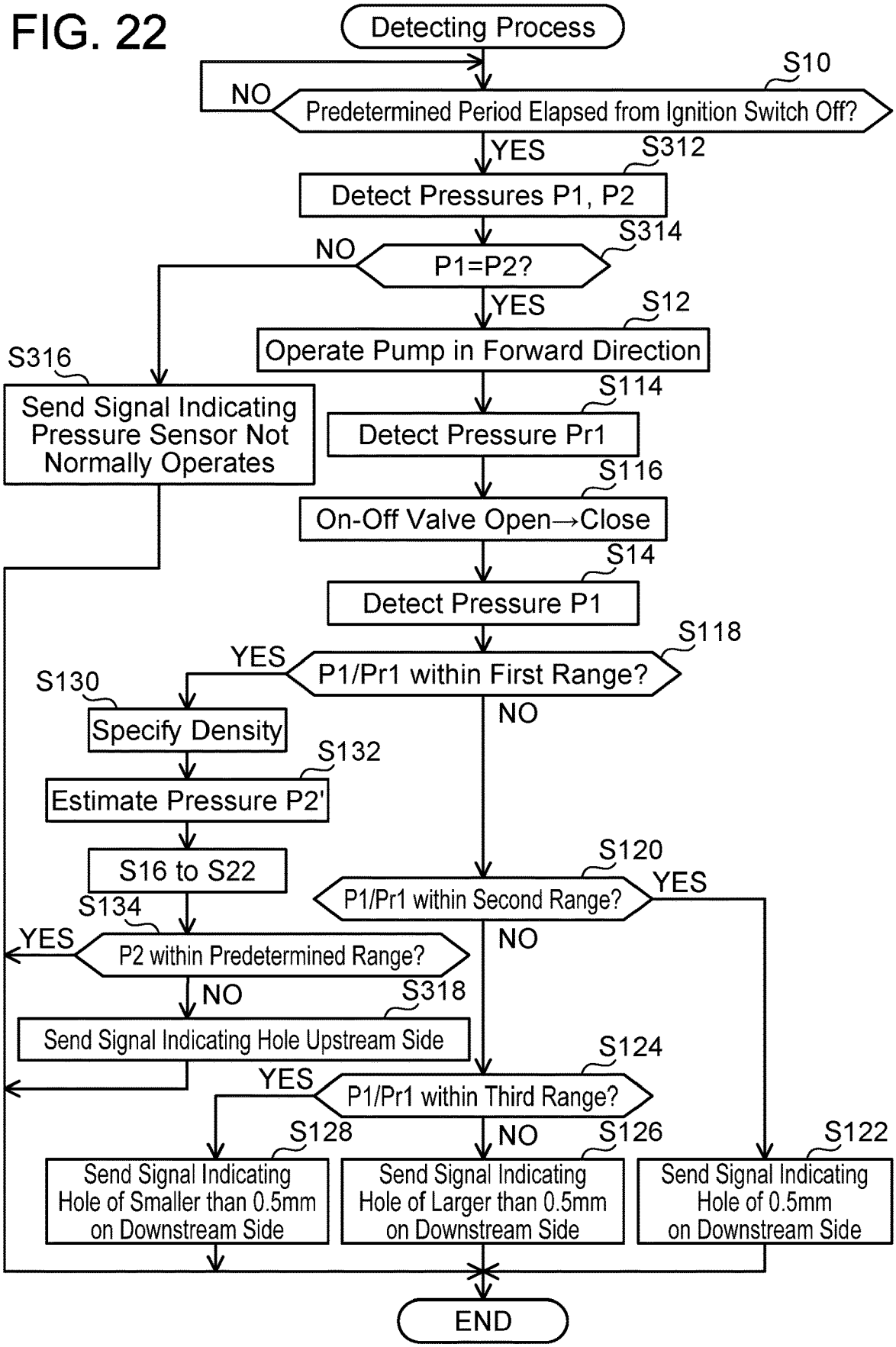
FIG. 22 shows a flowchart of a detecting process of a seventh embodiment.

Features differing from the fifth embodiment will be described. As compared to the fifth embodiment, the present embodiment differs in the detecting process. As shown in FIG. 22, the detecting process of the present embodiment detects the pressures P1, P2 by using the pressure sensors 50, 52 in S312 after the process of S10. In S312, the control valve 26 is closed, the switching valve 40 and the on-off valve 162 are open, and the pump 25 is stopped. In this state, the upstream side and the downstream side relative to the pump 25 are maintained at the atmospheric pressure. Thus, P1=P2 is satisfied when the pressure sensors 50, 52 are operating normally.

In S314, the ECU 100 determines whether P1=P2 is satisfied or not. In a case where P1=P2 is not satisfied (NO in S314), the ECU 100 sends a signal indicating that the pressure sensors 50, 52 are not operating normally to the display device of the vehicle in S316 and terminates the detecting process. When receiving the signal sent in S316, the display device of the vehicle displays a display indicating that the pressure sensors 50, 52 are not operating normally. Due to this, the driver can acknowledge that the pressure sensors 50, 52 are not operating normally.

On the other hand, in a case where P1=P2 is satisfied (YES in S314), the ECU 100 performs the processes of S12 to S128 of FIG. 17 and S130, S132, S16 to S22, and S134 of FIG. 18. In the process of S134, in the case where the pressure P2 is not included in the predetermined range determined based on the estimated pressure P2' (NO in S134), the ECU 100 sends a signal indicating the presence of a hole on the upstream side relative to the pump 25 to the display device of the vehicle in S318 and terminates the detecting process.

While specific examples of the present invention have been described above in detail, these examples are merely illustrative and place no limitation on the scope of the patent claims. The technology described in the patent claims also encompasses various changes and modifications to the specific examples described above.

(1) In the fifth embodiment, the evaporated fuel processing device 20 may not perform the processes of S136 to S144 in the detecting process. In this case, in the case where the pressure P2 is not in the predetermined range in S134 (NO in S134), the process of S146 may be performed.

(2) In the sixth embodiment, the determination is made on whether a hole (that is, a communicated point with the open air) is present or not on the downstream side relative to the pump 25 by using the pressure Pr1 and the pressure P1 (S114 to S128), and the determination is made on whether a hole is present or not on the upstream side relative to the pump 25 by using the pressure Pr2 and the pressure P2 (S208 to S226). However, for one of the upstream and downstream sides relative to the pump 25, the determination on whether a hole is present or not may be made by using the pressures P1, P2 without detecting the pressures Pr1, Pr2.

(3) In the seventh embodiment, the pressures P1, P2 are detected in S312 in the state where both the upstream and downstream sides relative to the pump 25 are opened to the open air. However, for detection of failure(s) in the pressure sensors 50, 52, both the upstream and downstream sides relative to the pump 25 simply need to be maintained at a same pressure, and thus the pressures P1, P2 may be detected, for example, in the state shown in FIG. 16.

(4) In the fifth embodiment, the pressure P2' is estimated by using the pressure Pr1 (S132). However, a pressure P1' which is an estimated value of the pressure P1 may be estimated after the pressure Pr2 has been detected first. Further, the pressure P2' may be estimated by using the pressure P1, and the pressure P1' may be estimated by using the pressure P2.

(5) In the first to fourth embodiments and in the sixth and seventh embodiments as well, the determination on whether the pressure sensors 50, 52 operate normally may be made. In this case, similarly to the fifth embodiment, both the upstream and downstream sides relative to the pump 25 may be set to the same pressure and detected values of the pressure sensors 50, 52 may be compared with each other. Alternatively, the detected value of the pressure sensor 50 may be compared with the atmospheric pressure in a state where the upstream side relative to the pump 25 is communicated with the open air. Similarly, the detected value of the pressure sensor 52 may be compared with the atmospheric pressure in a state where the downstream side relative to the pump 25 is communicated with the open air.

The technical elements explained in the present description or drawings provide technical utility either independently or through various combinations. The present invention is not limited to the combinations described at the time the claims are filed. Further, the purpose of the examples illustrated by the present description or drawings is to satisfy multiple objectives simultaneously, and satisfying any one of those objectives gives technical utility to the present invention.

REFERENCE SIGNS

2: Engine
4: Injector
6: Fuel Supply System
19: Canister
19*a*: Open Air Port
19*b*: Purge Port
19*c*: Tank Port
20: Evaporated Fuel Processing Device
22*a*: Purge Passage
22*c*: Purge Passage
25: Pump
26: Control Valve
34: Intake Passage
40: Switching Valve
50: Pressure Sensor
52: Pressure Sensor
100: ECU
122: Branch Passage
160: Decreased Portion
162: On-off Valve

The invention claimed is:

1. An evaporated fuel processing device comprising:

a canister disposed on a purge passage extending from a fuel tank to an intake passage of an engine, the canister comprising a purge port connected to the purge passage and an open air port communicating with open air, and the canister configured to adsorb fuel evaporated in the fuel tank;

a control valve disposed on the purge passage on an intake passage side relative to the canister and configured to switch between a communication state and a cutoff state, the communication state being a state where the canister and the intake passage communicate through the purge passage, and the cutoff state being a state where communication between the canister and the intake passage is cut off on the purge passage;

a pump disposed on the purge passage between the canister and the control valve, and configured to selectively perform both an operation of sending purge gas in the purge passage in a forward direction from the canister to the control valve and an operation of sending the purge gas in the purge passage in a reverse direction from the control valve to the canister;

a switching valve configured to switch between a communication state being a state where the open air port of the canister communicates with the open air and a cutoff state being a state where communication between the open air port of the canister and the open air is cut off; and a controller, wherein the controller is configured to determine whether there is a communicated point with the open air between the pump and the control valve or there is a communicated point with the open air on an opposite side to the control valve relative to the pump, by using a second pressure and at least one of a first pressure or a third pressure, wherein:

the first pressure is a pressure between the pump and the control valve in a first case where the control valve is in the cutoff state, the switching valve is in the communication state, and the pump performs the operation of sending the purge gas in the forward direction;

the second pressure is a pressure on the opposite side to the control valve relative to the pump in a second case where the control valve is in the communication state, the switching valve is in the cutoff state, and the pump performs the operation of sending the purge gas in the reverse direction; and the third pressure is a pressure between the pump and the control valve or on the opposite side to the control valve relative to the pump in a case where the control valve and the switching valve are in the cutoff states and the pump is stopped after the first case or the second case, at least one pressure sensor disposed at least one of between the pump and the control valve and on the opposite side to the control valve relative to the pump, and the controller is further configured to determine whether the at least one pressure sensor operates normally or not by using a detected value by the at least one pressure sensor in a case where the control valve is in the cutoff state, the switching valve is in the communication state, and the pump is stopped.

2. An evaporated fuel processing device comprising:

a canister disposed on a purge passage extending from a fuel tank to an intake passage of an engine, the canister comprising a purge port connected to the purge passage and an open air port communicating with open air, and the canister configured to adsorb fuel evaporated in the fuel tank;

a control valve disposed on the purge passage on an intake passage side relative to the canister and configured to switch between a communication state and a cutoff state, the communication state being a state where the canister and the intake passage communicate through the purge passage, and the cutoff state being a state where communication between the canister and the intake passage is cut off on the purge passage;

a pump disposed on the purge passage between the canister and the control valve, and configured to selectively perform both an operation of sending purge gas in the purge passage in a forward direction from the canister to the control valve and an operation of sending the purge gas in the purge passage in a reverse direction from the control valve to the canister;

a switching valve configured to switch between a communication state being a state where the open air port of the canister communicates with the open air and a cutoff state being a state where communication between the open air port of the canister and the open air is cut off; and a controller, wherein the controller is configured to determine whether there is a communicated point with the open air between the pump and the control valve or there is a communicated point with the open air on an opposite side to the control valve relative to the pump, by using a second pressure and at least one of a first pressure or a third pressure, wherein:

the first pressure is a pressure between the pump and the control valve in a first case where the control valve is in the cutoff state, the switching valve is in the communication state, and the pump performs the operation of sending the purge gas in the forward direction;

the second pressure is a pressure on the opposite side to the control valve relative to the pump in a second case where the control valve is in the communication state, the switching valve is in the cutoff state, and the pump performs the operation of sending the purge gas in the reverse direction; and the third pressure is a pressure between the pump and the control valve or on the opposite side to the control valve relative to the pump in a case where the control valve and the switching valve are in the cutoff states and the pump is stopped after the first case or the second case, the evaporated fuel processing device further comprises:

a branch passage comprising one end connected to the purge passage between the pump and the control valve and another end connected to the purge passage between the pump and the canister;

a decreased portion disposed on the branch passage and at which a flow passage area of the branch passage is decreased; and an on-off valve disposed on the branch passage and configured to switch between an open state where the purge gas is capable of passing through the on-off valve and a closed state where the purge gas is not capable of passing through the on-off valve, and the controller is configured to determine whether there is the communicated point with the open air between the pump and the control valve by using the first pressure in a case where the on-off valve is in the closed state under the first case and a fourth pressure in a case where the control valve is in the cutoff state, the switching valve is in the communication state, the on-off valve is in the open state, and the pump performs the operation of sending the purge gas in the forward direction.

3. An evaporated fuel processing device comprising:

a canister disposed on a purge passage extending from a fuel tank to an intake passage of an engine, the canister comprising a purge port connected to the purge passage and an open air port communicating with open air, and the canister configured to adsorb fuel evaporated in the fuel tank;

a control valve disposed on the purge passage on an intake passage side relative to the canister and configured to switch between a communication state and a cutoff state, the communication state being a state where the canister and the intake passage communicate through the purge passage, and the cutoff state being a state where communication between the canister and the intake passage is cut off on the purge passage;

a pump disposed on the purge passage between the canister and the control valve, and configured to selectively perform both an operation of sending purge gas in the purge passage in a forward direction from the canister to the control valve and an operation of sending the purge gas in the purge passage in a reverse direction from the control valve to the canister;

a switching valve configured to switch between a communication state being a state where the open air port of the canister communicates with the open air and a cutoff state being a state where communication between the open air port of the canister and the open air is cut off; and a controller, wherein the controller is configured to determine whether there is a communicated point with the open air between the pump and the control valve or there is a communicated point with the open air on an opposite side to the control valve relative to the pump, by using a second pressure and at least one of a first pressure or a third pressure, wherein:

the first pressure is a pressure between the pump and the control valve in a first case where the control valve is in the cutoff state, the switching valve is in the communication state, and the pump performs the operation of sending the purge gas in the forward direction;

the second pressure is a pressure on the opposite side to the control valve relative to the pump in a second case where the control valve is in the communication state, the switching valve is in the cutoff state, and the pump performs the operation of sending the purge gas in the reverse direction; and the third pressure is a pressure between the pump and the control valve or on the opposite side to the control valve relative to the pump in a case where the control valve and the switching valve are in the cutoff states and the pump is stopped after the first case or the second case, the evaporated fuel processing device, further comprises:

a branch passage comprising one end connected to the purge passage between the pump and the control valve and another end connected to the purge passage between the pump and the canister;

a decreased portion disposed on the branch passage and at which a flow passage area of the branch passage is decreased; and an on-off valve disposed on the branch passage and configured to switch between an open state where the purge gas is capable of passing through the on-off valve and a closed state where the purge gas is not capable of passing through the on-off valve, and wherein the controller is configured to determine whether there is the communicated point with the open air on the opposite side to the control valve relative to the pump by using the second pressure in a case where the on-off valve is in the closed state under the second case and a fifth pressure in a case where the control valve is in the communication state, the switching valve is in the cutoff state, the on-off valve is in the closed state, and the pump performs the operation of sending the purge gas in the reverse direction.

4. An evaporated fuel processing device comprising:

a canister disposed on a purge passage extending from a fuel tank to an intake passage of an engine, the canister comprising a purge port connected to the purge passage and an open air port communicating with open air, and the canister configured to adsorb fuel evaporated in the fuel tank;

a control valve disposed on the purge passage on an intake passage side relative to the canister and configured to switch between a communication state and a cutoff state, the communication state being a state where the canister and the intake passage communicate through the purge passage, and the cutoff state being a state where communication between the canister and the intake passage is cut off on the purge passage;

a pump disposed on the purge passage between the canister and the control valve, and configured to selectively perform both an operation of sending purge gas in the purge passage in a forward direction from the canister to the control valve and an operation of sending the purge gas in the purge passage in a reverse direction from the control valve to the canister;

a switching valve configured to switch between a communication state being a state where the open air port of the canister communicates with the open air and a cutoff state being a state where communication between the open air port of the canister and the open air is cut off; and a controller, wherein the controller is configured to determine whether there is a communicated point with the open air between the pump and the control valve or there is a communicated point with the open air on an opposite side to the control valve relative to the pump, by using a second pressure and at least one of a first pressure or a third pressure, wherein:

the first pressure is a pressure between the pump and the control valve in a first case where the control valve is in the cutoff state, the switching valve is in the communication state, and the pump performs the operation of sending the purge gas in the forward direction;

the second pressure is a pressure on the opposite side to the control valve relative to the pump in a second case where the control valve is in the communication state, the switching valve is in the cutoff state, and the pump performs the operation of sending the purge gas in the reverse direction; and the third pressure is a pressure between the pump and the control valve or on the opposite side to the control valve relative to the pump in a case where the control valve and the switching valve are in the cutoff states and the pump is stopped after the first case or the second case, the controller is further configured to:

estimate a density of the purge gas by using the first pressure;

estimate a sixth pressure on the opposite side to the control valve relative to the pump in the second case by using the estimated density of the purge gas; and determine whether there is the communicated point with the open air on the opposite side to the control valve relative to the pump by using the second pressure and the sixth pressure.

* * * * *